US009389584B2

(12) United States Patent
Uchida et al.

(10) Patent No.: US 9,389,584 B2
(45) Date of Patent: Jul. 12, 2016

(54) ELECTROPHOTOGRAPHIC IMAGE FORMING APPARATUS, PROCESS CARTRIDGE AND DEVELOPING CARTRIDGE

(75) Inventors: Wataru Uchida, Yokohama (JP); Takeshi Niimura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 882 days.

(21) Appl. No.: 13/144,400

(22) PCT Filed: Apr. 16, 2010

(86) PCT No.: PCT/JP2010/057202

§ 371 (c)(1),
(2), (4) Date: Jul. 13, 2011

(87) PCT Pub. No.: WO2010/119993

PCT Pub. Date: Oct. 21, 2010

(65) Prior Publication Data

US 2012/0039624 A1 Feb. 16, 2012

(30) Foreign Application Priority Data

Apr. 17, 2009 (JP) ..... 2009-100773
Apr. 2, 2010 (JP) ..... 2010-085888

(51) Int. Cl.
*G03G 15/00* (2006.01)
*G03G 21/18* (2006.01)

(52) U.S. Cl.
CPC .... *G03G 21/1853* (2013.01); *G03G 2221/1684* (2013.01)

(58) Field of Classification Search
USPC ..... 399/110
See application file for complete search history.

(56) References Cited

U.S. PATENT DOCUMENTS 7,274,894 B2 9/2007 Sato et al.
7,395,008 B2 7/2008 Sato et al.

(Continued)

FOREIGN PATENT DOCUMENTS

CN 1525528 A 9/2004
CN 101000487 A 7/2007

(Continued)

OTHER PUBLICATIONS

Notification of the First Office Action (PCT Application in the National Phase) dated Jan. 4, 2013, in Chinese Application No. 201080016289.6.

(Continued)

*Primary Examiner* — David Gray
*Assistant Examiner* — Geoffrey Evans
(74) *Attorney, Agent, or Firm* — Fitzpatrick, Cella, Harper & Scinto

(57) ABSTRACT

An image forming apparatus includes a main assembly, and a supporting member capable of supporting a plurality of developing rollers and a plurality of photosensitive drums, with the supporting member being movable substantially linearly between an inside position inside of the main assembly and an outside position outside of the main assembly while supporting the developing rollers and the photosensitive drums. In addition, a plurality of developing cartridges each have the developing roller and are mountable to and dismountable from the supporting member which supports the plurality of photosensitive drums when the supporting member is in the outside position. The developing cartridges each include an upper surface facing upward when mounted to the supporting member and a projection projecting upwardly from the upper surface and having a shape providing a space through a middle portion thereof.

6 Claims, 23 Drawing Sheets

(56) References Cited

U.S. PATENT DOCUMENTS

| | | | | |
|---|---|---|---|---|
| 7,415,223 | B2 | 8/2008 | Sato et al. | |
| 7,486,909 | B2 | 2/2009 | Sato et al. | |
| 7,489,889 | B2 | 2/2009 | Sato et al. | |
| 7,715,752 | B2 | 5/2010 | Sakurai et al. | |
| 7,890,012 | B2 | 2/2011 | Koishi et al. | |
| 7,937,020 | B2 | 5/2011 | Sakurai et al. | |
| 8,036,572 | B2 * | 10/2011 | Maeda | 399/119 |
| 8,213,828 | B2 | 7/2012 | Murayama et al. | |
| 8,260,171 | B2 * | 9/2012 | Matsuda | 399/110 |
| 8,320,794 | B2 * | 11/2012 | Kikuchi et al. | 399/111 |
| 8,442,415 | B2 * | 5/2013 | Ushiozu | 399/110 |
| 8,706,003 | B2 * | 4/2014 | Hashimoto et al. | 399/110 |
| 2004/0165910 | A1 | 8/2004 | Sato et al. | |
| 2006/0153589 | A1 | 7/2006 | Sato et al. | |
| 2006/0228131 | A1 | 10/2006 | Kimura et al. | |
| 2007/0077087 | A1 * | 4/2007 | Okabe et al. | 399/111 |
| 2007/0160380 | A1 | 7/2007 | Imaizumi et al. | |
| 2007/0160384 | A1 | 7/2007 | Sakurai et al. | |
| 2007/0183814 | A1 * | 8/2007 | Kamimura | 399/228 |
| 2008/0019731 | A1 | 1/2008 | Sato et al. | |
| 2008/0019732 | A1 | 1/2008 | Sato et al. | |
| 2008/0159772 | A1 | 7/2008 | Koishi et al. | |
| 2008/0159773 | A1 | 7/2008 | Murayama et al. | |
| 2008/0232852 | A1 | 9/2008 | Sato et al. | |
| 2009/0003875 | A1 * | 1/2009 | Toba et al. | 399/111 |
| 2009/0003876 | A1 * | 1/2009 | Maeshima et al. | 399/111 |
| 2009/0162095 | A1 * | 6/2009 | Yoshimura et al. | 399/114 |
| 2010/0054800 | A1 * | 3/2010 | Okabe | 399/114 |
| 2010/0074646 | A1 * | 3/2010 | Miyahara et al. | 399/99 |
| 2010/0080622 | A1 | 4/2010 | Uchida | |
| 2010/0209139 | A1 | 8/2010 | Sakurai et al. | |
| 2011/0064463 | A1 * | 3/2011 | Hashimoto et al. | 399/119 |
| 2011/0123223 | A1 | 5/2011 | Koishi et al. | |
| 2011/0311274 | A1 * | 12/2011 | Ishii | 399/113 |
| 2012/0177403 | A1 | 7/2012 | Murayama et al. | |
| 2014/0161483 | A1 * | 6/2014 | Fukui et al. | 399/110 |

FOREIGN PATENT DOCUMENTS

| | | | |
|---|---|---|---|
| CN | 101211154 | A | 7/2008 |
| CN | 101479671 | A | 7/2009 |
| EP | 1610188 | A2 | 12/2005 |
| EP | 1643315 | A2 | 4/2006 |
| EP | 1816527 | A2 | 8/2007 |
| JP | 11-296049 | A | 10/1999 |
| JP | 3592522 | B2 | 11/2004 |

OTHER PUBLICATIONS

Notification of Transmittal of the International Search Report and the Written Opinion of the International Searching Authority mailed Oct. 19, 2010, forwarding the International Search Report and the Written Opinion in International Application No. PCT/JP2010/057202.

* cited by examiner (a) CLOSED (b) PARTLY OPENED (c) COMPLETELY OPENED (a)

(b)

ELECTROPHOTOGRAPHIC IMAGE FORMING APPARATUS, PROCESS CARTRIDGE AND DEVELOPING CARTRIDGE

TECHNICAL FIELD

The present invention relates to an electrophotographic image forming apparatus for forming an image on a recording material (medium) in a state in which a process cartridge and a developing cartridge are detachably mounted. Further, the present invention relates to the process cartridge used in the electrophotographic image forming apparatus and the developing cartridge used in the electrophotographic image forming apparatus.

The electrophotographic image forming apparatus employs an electrophotographic photosensitive member to form an electrostatic latent image on the electrophotographic photosensitive member through an electrophotographic image forming process and forms an image on the recording material. For example, the electrophotographic image forming apparatus may include an electrophotographic copying machine, an electrophotographic printer (an LED printer, a laser beam printer, etc.), an electrophotographic facsimile machine, and an electrophotographic word processor. It is also possible to use a monochromatic or full-color electrophotographic image forming apparatus used as an output device such as a multi-function device having functions of the above-described machines or a work station. The recording material is subjected to image formation by the electrophotographic image forming apparatus and may include a sheet, an OHP sheet, and the like. Incidentally, the process cartridge and the developing cartridge are to be detachably mounted in a main assembly of the electrophotographic image forming apparatus, thus contributing to an image forming process for forming the image on the recording material. Here, the process cartridge is prepared by integrally assembling an electrophotographic photosensitive drum and, as a process means, a charging means and/or a cleaning means into a cartridge, which is detachably mounted in the apparatus main assembly. The process cartridge and the developing cartridge are mountable to and demountable from the apparatus main assembly by a user himself (herself) of the image forming apparatus. For this reason, maintenance of the apparatus main assembly can be easily performed. The process means acts on the electrophotographic photosensitive drum. Further, the developing cartridge includes a developing roller and accommodates a developer (toner) used for developing the electrostatic latent image formed on the electrophotographic photosensitive drum by the developing roller, and is to be detachably mounted in the main assembly.

BACKGROUND ART

In recent years, it has been known a cartridge-type electrophotographic image forming apparatus with a low running cost and easy maintenance. In the image forming apparatus, exchange of consumables such as the electrophotographic photosensitive member and the developer (hereinafter referred to as toner) is enabled to reduce the running cost. Such a technique for satisfying that the exchange of the consumables such as the photosensitive member or the toner is enabled to reduce the running cost has been described (Japanese Patent No. 3592522). In this technique, in a state in which a photosensitive member unit (image bearing member unit) including a photosensitive drum and a developing unit accommodating the toner are mounted in a holder member, the holder member can be pulled out from a main assembly of an electrophotographic image forming apparatus.

In the electrophotographic image forming apparatus described in Japanese Patent No. 3592522, when the image bearing member unit is demounted from a pull-out member, a positioning supporting shaft is required to be demounted. Further, when a developing device is demounted from the pull-out member, a knob is required to be demounted from a central shaft of the developing device. Here, the positioning supporting member is inserted into a hole provided in a front side plate of the pull-out member, a hole provided in a side plate of the unit holder, and a center hole formed in a flange member on the front side of the image bearing member. Further, the knob is rotatably supported by the front side plate of the pull-out member through a bearing and is detachably mounted on a central shaft end portion on the more front side than the front side plate. Therefore, when the image bearing member unit and the developing device are demounted from the pull-out member, the above-described positioning supporting shaft and knob are required to be demounted. As a result, it is considered that it takes much time.

DISCLOSURE OF THE INVENTION

A principal object of the present invention is to provide an electrophotographic image forming apparatus improved in demounting operativity for demounting a process cartridge and a developing cartridge from a cartridge supporting member. Further, an object of the present invention is to provide the process cartridge and the developing cartridge for use in the electrophotographic image forming apparatus and for achieving the above principal object.

Another object of the present invention is to provide an electrophotographic image forming apparatus from which each of the process cartridge and the developing cartridge can be independently and separately demounted when the process cartridge and the developing cartridge are demounted from the cartridge supporting member and from which the order of the demounting is not limited. Further, an object of the present invention is to provide the process cartridge and the developing cartridge for use in the electrophotographic image forming apparatus and for achieving the above another object.

A further object of the present invention is to provide an electrophotographic image forming apparatus from which each of the process cartridge and the developing cartridge can be independently and separately demounted when the process cartridge and the developing cartridge are demounted from the cartridge supporting member and which enables the demounting even when either of these cartridges is demounted first. Further, an object of the present invention is to provide the process cartridge and the developing cartridge for use in the electrophotographic image forming apparatus and for achieving the above further object.

A still further object of the present invention is to provide an electrophotographic image forming apparatus enabling demounting of a process cartridge and a developing cartridge from a cartridge supporting member independently and separately by a user himself (herself). Further, an object of the present invention is to provide the process cartridge and the developing cartridge for use in the electrophotographic image forming apparatus and for achieving the above still further object.

According to an aspect of the present invention, there is provided an electrophotographic image forming apparatus for forming an image on a recording material, comprising:

a process cartridge, including an electrophotographic photosensitive drum and process means actable on the electrophotographic photosensitive drum, for being detachably mountable to a main assembly of the electrophotographic image forming apparatus;

a developing cartridge, including a developing roller for developing an electrostatic latent image formed on the electrophotographic photosensitive drum with a developer and including a developer accommodating portion, for being detachably mountable to the main assembly; and a cartridge supporting member movable, while supporting at least a pair of the process cartridge and the developing cartridge, between an inside position in which the cartridge supporting member is located inside the main assembly and in which the pair of the process cartridge and the developing cartridge is located at an image forming position and an outside position in which the cartridge supporting member is located outside the main assembly and in which the process cartridge and the developing cartridge are mountable and demountable, wherein the process cartridge and the developing cartridge are independently demountable upward relative to the cartridge supporting member when the cartridge supporting member is located at the outside position, and wherein the apparatus further comprises positioning means for positioning the process cartridge and the developing cartridge in the main assembly when the cartridge supporting member is located at the inside position.

These and other objects, features and advantages of the present invention will become more apparent upon a consideration of the following description of the preferred embodiments of the present invention taken in conjunction with the accompanying drawings.

BEST MODE FOR CARRYING OUT THE INVENTION

Embodiment 1

General Structure of Electrophotographic Image Forming Apparatus

As electrophotographic image forming apparatus 100 in this embodiment, a full-color laser printer will be described by way of examples. In the following description, a front side (front surface side) of the electrophotographic image forming apparatus 100 means the side on which a door (an opening/closing member) 31 is provided. A rear side of the image forming apparatus 100 is the side opposite from the front side. A front-rear direction includes a frontward direction toward front as seen from the rear side of the image forming apparatus 100, and a rearward direction is opposite from the frontward direction. The left and right sides mean the left and right sides as seen from the front side of the image forming apparatus 100. A left-right direction includes a leftward direction toward left as seen from the front side, and a rightward direction is opposite from the leftward direction. An apparatus main assembly 100A is a portion of an image forming apparatus except a drum cartridge (process cartridge) DR and a developing cartridge DV.

The drum cartridge (process cartridge) DR includes the rotatable electrophotographic photosensitive drum 1 and at least one process means, except a developing means, acting on the drum 1. In this embodiment, the drum cartridge DR Includes, as the process means, a charging roller (charging means) 2 and a cleaning blade 3*a* (cleaning means 3). Further, the developing cartridge DV includes a developing roller (developing means) for developing an electrostatic latent image formed on the drum 1 with a developer and a developer accommodating container (developer accommodating portion) for accommodating the developer. The cartridges DR and DV are detachably mounted in the main assembly 100A by a user himself (herself). Further, relative to the apparatus 100, the right side is a driving side and the left side is a non-driving side.

Figure 1A:
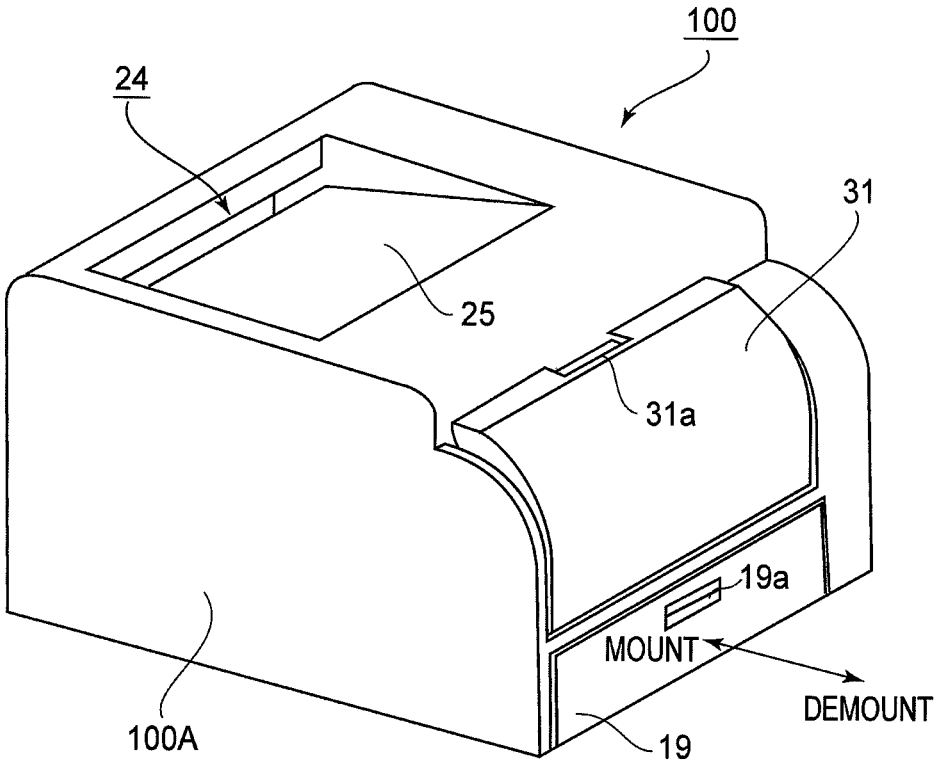
FIG. 1A is a perspective view of an outer appearance of an image forming apparatus in Embodiment 1.
Figure 1B:
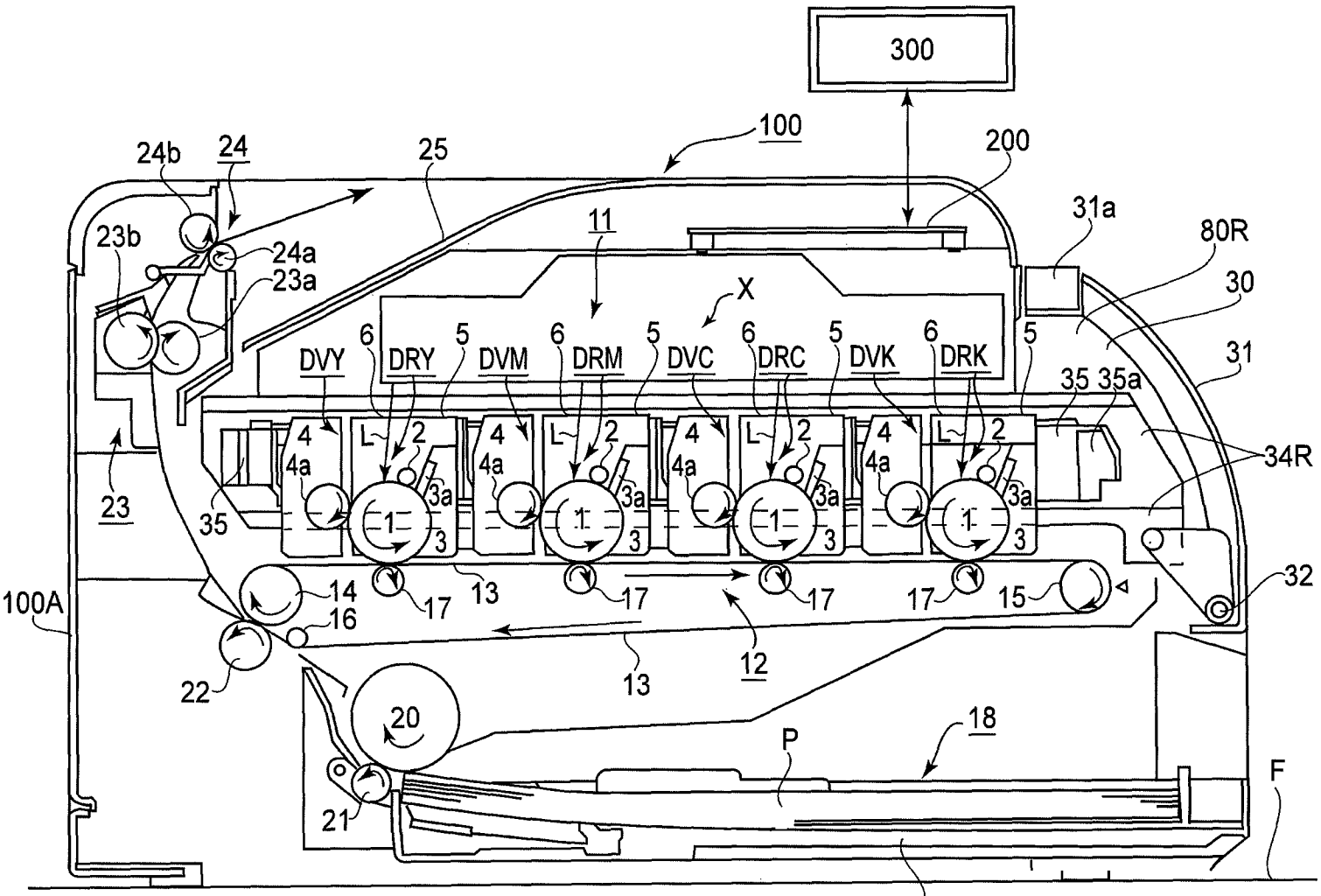
FIG. 1B is a longitudinal left side view of the image forming apparatus.

FIG. 1A is a perspective view of an outer appearance of the apparatus 100 in this embodiment, and FIG. 1B is a longitudinal left side view of the apparatus 100. The apparatus 100 is mounted on a substantially horizontal mounting (disposing) surface F of a mounting table, a desk, a floor, or the like. The horizontal direction is a direction parallel to the mounting surface F. The apparatus 100 is a four color-based full-color laser printer using an electrophotographic process. That is, the apparatus 100 effects image formation on a sheet (recording material) P on the basis of an electrical image signal input from an external host device 300, such as a personal computer, an image reader, or a remote facsimile machine, into a control circuit portion (control means: CPU (central processing unit)) 200. The host device 300 and the circuit portion 200 are connected through LAN (local area network). The circuit portion 200 exchanges various pieces of electrical information between itself and the host device 300 or an operating portion (not shown) of the apparatus 100 and also effects centralized control of an image forming operation of the apparatus 100 in accordance with a predetermined control program or a predetermined reference table. Therefore, the image forming operation described below is controlled by the circuit portion 200.

In the apparatus main assembly 100A, four drum cartridges DR and four developing cartridges DV are juxtaposed from the rear side to the front side. That is, first to fourth drum cartridges DR (process cartridges) (DRY, DRM, DRC and DRK) and first to fourth developing cartridges DV (DVY, DVM, DVC and DVK) are substantially horizontally arranged in this order with respect to a rear-to-front direction. In other words, the apparatus 100 in this embodiment is of an in-line type or tandem type. A pair of the first drum cartridge DRY and the first developing cartridge DVY constitutes a yellow image forming portion. A pair of the second drum cartridge DRM and the second developing cartridge constitutes a magenta image forming portion. A pair of the third drum carriage DRC and the third developing cartridge DVC constitutes a cyan image forming portion. A pair of the fourth drum cartridge DRK and the fourth developing cartridge DVK constitutes a black image forming portion.

The respective cartridges DR have the same constitution. In this embodiment, each cartridge DR includes a rotatable (electrophotographic photosensitive) drum 1. The cartridge DR also includes the charging roller 2 (charging means) and the cleaning blade 3*a* (cleaning means 3) as the process means acting on the drum 1. The drum 1, the charging roller 2 and the cleaning blade 3*a* are integrally supported by a drum cartridge frame 5. The charging roller 2 contacts and electrically charges the drum 1. The blade 3*a* removes toner remaining on the drum 1. The drum cartridges DR may include at least either one of the charging roller 3 and the cleaning blade 3*a*. Each cartridge DV includes a developing roller 4*a* for supplying powdery toner to the drum 1 of an associated cartridge DR and includes a developer accommodating container (developer accommodating portion) 4 accommodating the powdery toner. The respective cartridges DV have the same constitution except that the colors of powdery developers (toners) accommodated in containers 3 are different from each other.

The container 4 of the first cartridge DVY stores yellow (Y) toner. On the surface of the drum 1 in the first cartridge DRY, a toner (developer) image of yellow (Y) is formed. The container 4 of the second cartridge DVM stores magenta (M) toner. On the surface of the drum 1 in the second cartridge DRM, a toner image of magenta (M) is formed. The container 4 of the third cartridge DVC stores cyan (C) toner. On the surface of the drum 1 in the third cartridge DRC, a toner image of cyan (C) is formed. The developing device 3 of the fourth cartridge DVK stores black (K) toner. On the surface of the drum 1 in the fourth cartridge DRK, a toner image of black (K) is formed.

In the area above the first to fourth cartridges DR and the first to fourth cartridges DV which have been mounted in the main assembly 100A, a laser scanner unit (an image exposure means) 11 is disposed. This scanner unit 11 outputs a beam of laser light L modulated correspondingly to image (picture) information for each color input from the host device 300 into the circuit portion 200. Through an exposure opening 6 provided at an upper surface of a developing cartridge frame 401 (FIG. 8(*a*)), scanning exposure is performed on the surface of the drum 1 of each cartridge DR. As a result, an electrostatic latent image depending on the image information is formed on each drum.

Below the first to fourth cartridge DR and the first to fourth cartridge DV which have been mounted in the main assembly 100A, an intermediary transfer belt unit 12 is provided. This belt unit 12 includes an endless belt (intermediary transfer member) 13 formed of a dielectric material and having flexibility. The belt unit 12 further includes a driving roller 14, a turn roller 15 and a tension roller 16 around which the belt 13 is stretched and circulatively moved. The driving roller 14 and tension roller 16 are disposed inside and on the rear side of the main assembly 100A, whereas the turn roller 15 is disposed inside and on the front side of the main assembly 100A. A lower surface of each drum 1 contacts an upper surface of the belt 13. Inside the belt 13, four primary transfer rollers 17 are disposed so that each transfer roller 17 opposes the drum 1 through the belt 13. The driving roller 14 is disposed opposite to a secondary transfer roller 22 through the belt 13.

Below the belt unit 12, a feeding unit 18 is disposed, which includes a cassette (tray) 19, a feeding roller 20, a separation roller 21, and the like. The cassette 19 is detachably mountable to the apparatus 100 from the front side (front loading). As shown in FIG. 1A, the cassette 19 is provided with a grip 19*a* at its front surface.

Inside and at an upper rear side of the main assembly 100A, a fixing device 23 and a discharging roller pair 24 are provided. Further, an upper surface of the main assembly 100A constitutes a tray 25 which is configured to receive the sheet P after the image formation. The fixing device 23 includes a fixation film assembly 23*a* and a pressing roller 23*b*. The discharging roller pair 24 includes a roller 24*a* and a discharging roller 24*b*.

An operation for forming a full-color image by the apparatus 100 is as follows (FIG. 1B). The drum 1 of each of the first to fourth cartridges DR is rotationally driven with predetermined control timing in a counterclockwise direction indicated by an arrow. Further, the belt 13 is rotationally driven in a clockwise direction indicated by an arrow (in the same (normal) rotational direction as that of the drum 1 at their contact portion) at a speed corresponding to the speed of the drum 1. The scanner unit 11 is also driven. In synchronization with the driving of the scanner unit 11, the charging roller 2 in each cartridge DR uniformly electrically charges the surface of the drum 1 to predetermined polarity and potential with predetermined control timing. The scanner unit 11 scans (exposes) the surface of the drum 1 of each cartridge DR with the beam of laser light L correspondingly to the picture (image) signals for respective colors with a predetermined timing. As a result, an electrostatic latent image corresponding to the picture signals for corresponding color is formed on the surface of the drum 1. The electrostatic latent image is developed by the developing roller 4*a* of an associated cartridge DV as a toner image (developer image). As a result, the yellow (Y) toner image, which corresponds to the yellow color component of a full-color image, is formed on the drum 1 of the cartridge DRY. This yellow toner image is primary-transferred onto the belt 13. Similarly, the magenta (M) toner image is formed on the drum 1 of the cartridge DRM, the cyan (C) toner image is formed on the drum 1 of the cartridge DRC, and the black (K) toner image is formed on the drum 1 of the cartridge DRK. Then, these toner images are successively transferred onto the belt 13 (primary transfer). Toner images corresponding to the respective color components of the full-color image, i.e., the toner images of Y, M, C and K are primary-transferred superposedly on the belt 13. Incidentally, the above-described primary transfer is performed by applying a primary-transfer bias to each of primary transfer rollers 17.

Consequently, an unfixed full-color toner image based on the four colors of Y, M, C and K is formed on the belt 13.

After the transfer of the toner image onto the belt 13, the transfer residual toner remaining on the surface of the drum 1 is removed by the cleaning blade 3*a*.

Meanwhile, the roller 20 is driven with predetermined control timing. As a result, one of sheets (recording material) P stacked on the cassette 19 is fed by cooperation of the roller 20 and the separation roller 21. Then, the sheet P is introduced into a nip (secondary transfer nip) between the secondary transfer roller 22 and belt 13. During conveyance of the sheet P in the nip, a secondary transfer bias is applied to a transfer roller 22. As a result, the superposed four color toner images on the belt 13 are collectively transferred onto the sheet P.

The sheet P is separated from the surface of the belt 13 and introduced into the fixing device 23, and is subjected to heat and pressure in a fixation nip of the fixing device 23. As a result, the respective color toner images are fixed on the sheet P. Thereafter, the sheet P is moved out of the fixing device 23, and then, is discharged as a full-color image formation product onto the tray 25 by the roller pair 24.

(Cartridge Exchange Method)

As each cartridge DV is used for image formation, the developer (toner) stored in the associated container 4 is consumed. Then, when the developer is consumed, the associated cartridge is exchanged. For example, the image forming apparatus is provided with a means (not shown) for detecting an amount of the developer remaining in each cartridge DV. The detected amount value of the developer is compared, by the control circuit portion 200, with a threshold value preset for issuing a prewarning or warning of the lifetime of the cartridge DV. With respect to the cartridge DV in which the detected amount value of the residual developer is smaller than the threshold value, the prewarning or warning of the lifetime of the cartridge DV is displayed on a display portion (not shown). As a result, the image forming apparatus prompts the user to prepare an exchange cartridge DV or to exchange the cartridge DV. Further, each cartridge DR is increased in the amount of the removed toner (residual toner) accommodated in a removed toner accommodating portion 3 with the use thereof for the image formation. When the amount of the toner accommodated in the accommodating portion 3 exceeds an accommodatable amount, the cartridge DR is exchanged. For this purpose, e.g., a means (not shown) for detecting the accommodated amount of the removed toner in each cartridge DR is provided. The detected amount value is compared, in the control circuit portion, with a threshold value preset for providing the prewarning or warning of the lifetime of the cartridge DR. With respect to the cartridge DR in which the detected amount value is larger than the threshold value, the prewarning or warning of the lifetime of the cartridge DR is displayed on the display portion (not shown). As a result, the image forming apparatus prompts the user to prepare the exchange cartridge DR or to exchange the cartridge DR.

Figure 2:
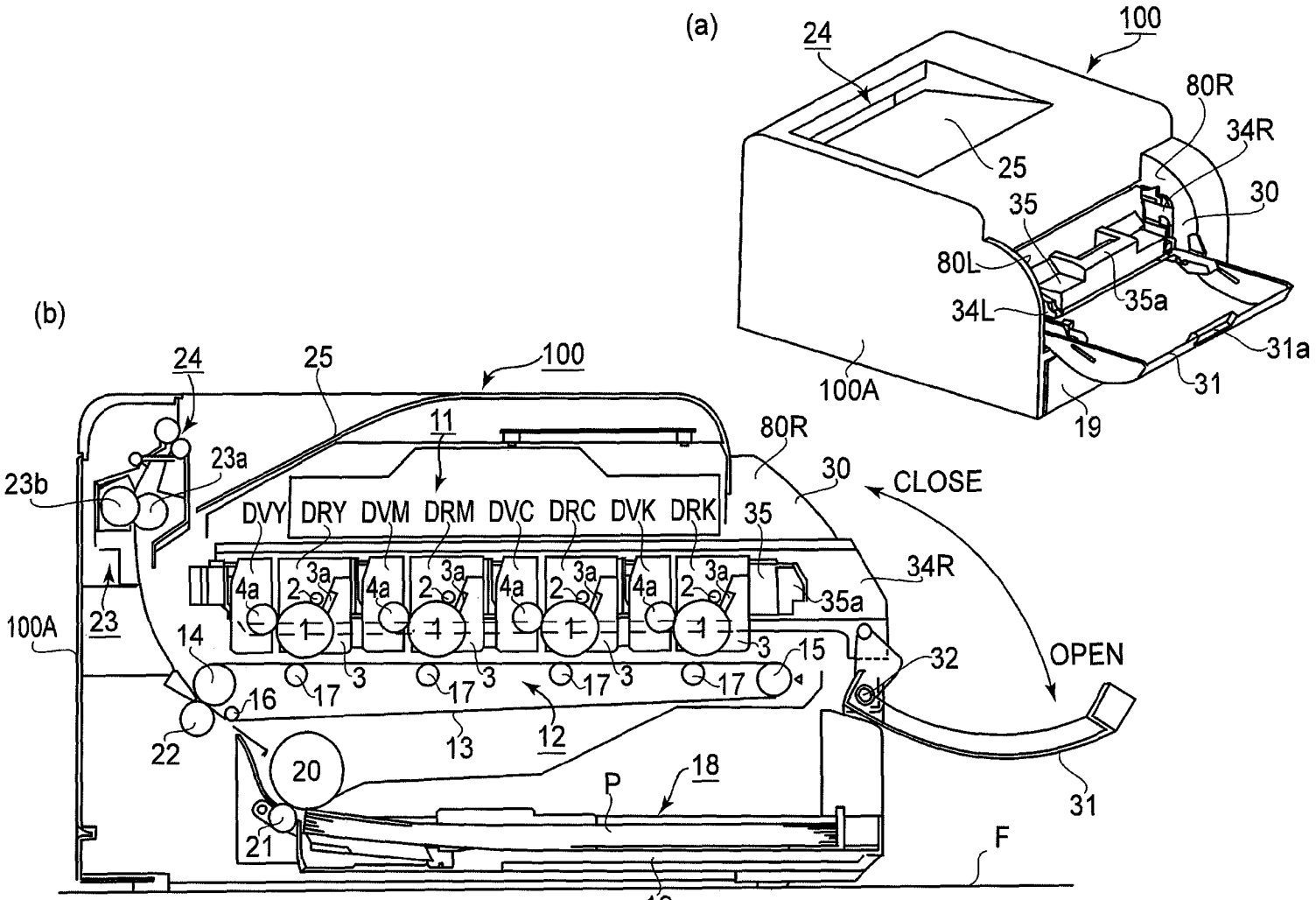
FIG. 2(*a*) is a perspective view of the outer appearance of the image forming apparatus in a state in which a front door is opened, and FIG. 2(*b*) is a longitudinal left side view of the image forming apparatus in the state in which the front door is opened.

In this embodiment, the exchange of each of the cartridges DV and DR is made by placing the cartridge DV or DR on a pull-out tray (cartridge supporting member) 35. As a result, the user can exchange the cartridges DV and DR in a front-access manner. In the front-access manner, the cartridge exchange operation can be performed from the front side of the apparatus 100. The apparatus 100 is provided with an opening 30 on its front side. The opening 30 permits passing of the tray 35 supporting the cartridge DV and the cartridge DR therethrough. As a result, the cartridge CV and the cartridge DR can be inserted into and demounted from the main assembly 100A. Further, a door (openable member) 31 movable between a closing position in which the opening 30 is covered and an opening position in which the opening 30 is exposed is provided. In this embodiment, the door 31 can be rotationally moved for opening and closing about a hinge shaft 32, provided at a lower portion of the door 31, relative to the main assembly 100A. That is, the door 31 is rotationally moved upward about the hinge shaft 32, so that the opening 30 is covered in FIGS. 1A and 1B. Further, the door 31 is rotationally moved frontward about the hinge shaft 32, so that the opening 30 is exposed (FIG. 2(*a*) and FIG. 2(*b*)). The door 31 is provided with a holding portion 31*a*. The user holds the holding portion 31*a* to open and close the door 31. Inside left and right frames 80L and 80R of the main frame of the main assembly 100A, a pair of left and right tray supporting members (main assembly-side guide or movable means) 34L and 34R are oppositely disposed, respectively and extend in a front-rear direction as a longitudinal direction thereof. By the tray supporting members 34L and 34R, the cartridge tray (cartridge supporting member or movable member) 35 which is a frame member is supported substantially horizontally slidably in the front-rear direction. Each cartridge DR and each cartridge DV are demountably supported by the tray 35. In interrelation with the opening of the door 31 (an interrelating means will be described later), the tray supporting members 34L and 34R are moved frontward and upward from the position shown in FIG. 1B by a predetermined distance. As a result, front-side portions of the supporting members 34L and 34R are pulled out to a position in which the front-side portions are projected toward the outside of the main assembly 100A by a predetermined distance as shown in FIGS. 2(*a*) and 2(*b*). Further, in interrelation with the movement of the supporting members 34L and 34R, transmission and elimination of a driving force between each of the cartridges DR and DV and the main assembly 100A. This constitution will be described later. Further, in interrelation with the opening of the door 31, positioning of each of the cartridges DR and DV relative to the main assembly 100A is released. By this release of the positioning, the developing roller 4*a* of the cartridge DV is placed in a state in which it is separated from the drum 1 of the cartridge DR. Further, by the above-described movement of the supporting members 34L and 34R, the lower surface of the drum 1 is separated from the belt 13. Further, the tray 35 is placed in a state in which movement prevention thereof, by a tray movement preventing means described later, relative to the main assembly 100A is eliminated. By the above-described series of operations of the apparatus 100, the tray 35 is placed in a state in which it is movable in the pull-out direction along the tray supporting members 34L and 34R. Then, the user holds the grip 35*a* which is exposed through the opening 30 and is provided to a front end portion of the tray 35. Then, the user is sufficiently pulls out the tray 35 along the supporting members 34L and 34R to a predetermined pull-out position (outside position) Y located outside the main assembly 100A (FIGS. 3(*a*) and 3(*b*)). An arrow a represents a pull-out movement direction of the tray 35. As a result, the entire cartridges DR and DV supported by the tray 35 pass through the opening 30 and are exposed outside the main assembly 100A. As a result upper surfaces of all the cartridges DR and DV are exposed outside the main assembly 100A. At this time, the lower surface of the drum 1 of each cartridge DR is separated from the belt 13, so that friction between the lower surface of the drum 1 and the belt 13 does not occur. When the tray 35 is sufficiently pulled out to the predetermined outside position (pull-out position) Y, the tray 35 is prevented from being further pulled out and moved by a stopper portion (not shown). Further, the tray 35 is kept in a state, in which the tray 35 is horizontally pulled out to the outside position Y, by the supporting members 34L and 34R.

Figure 3:
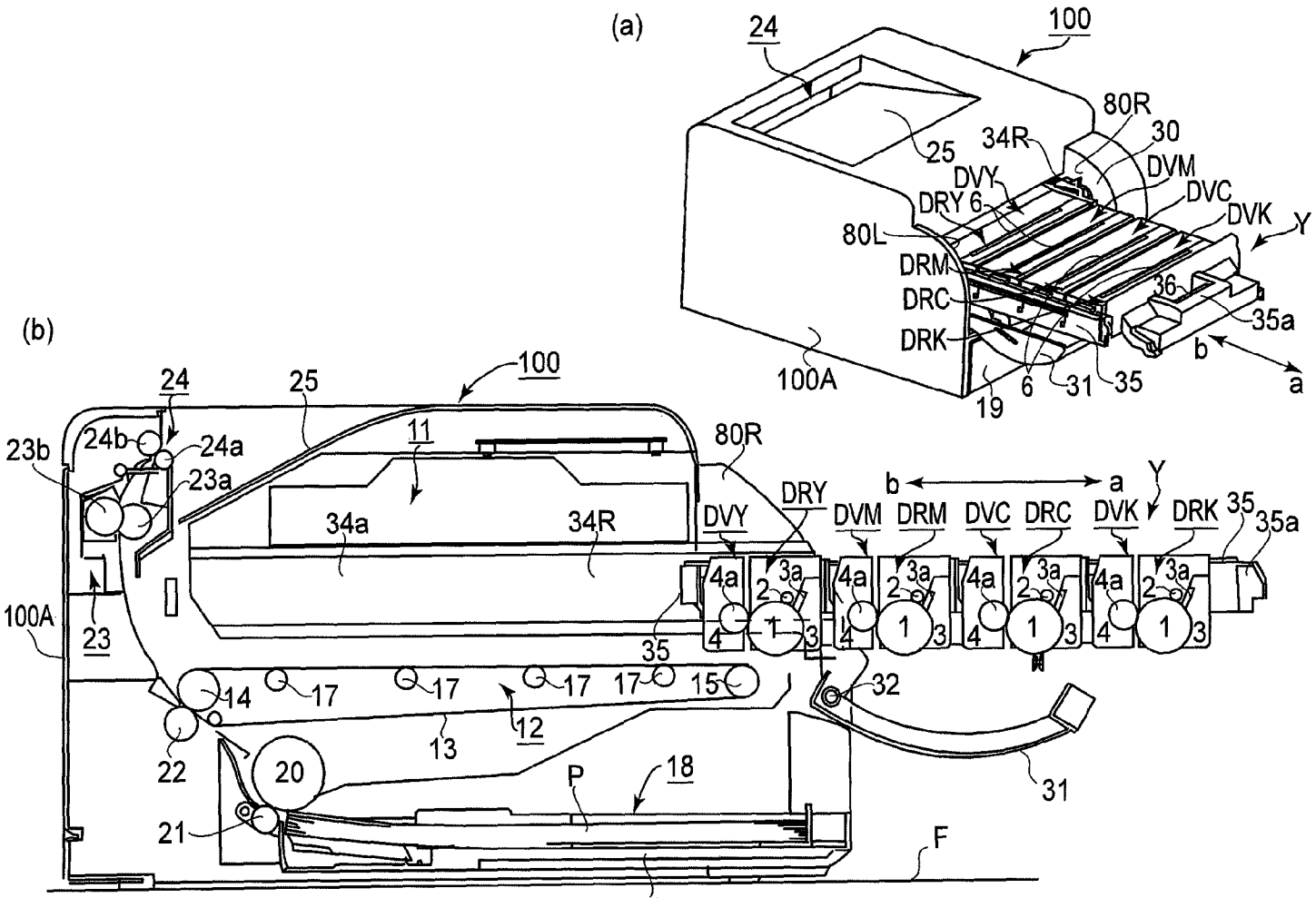
FIG. 3(*a*) is a perspective view of the outer appearance of the image forming apparatus in a state in which a tray is pulled out, and FIG. 3(*b*) is a longitudinal left side view of the image forming apparatus in the state in which the tray is pulled out.
Figure 4A:
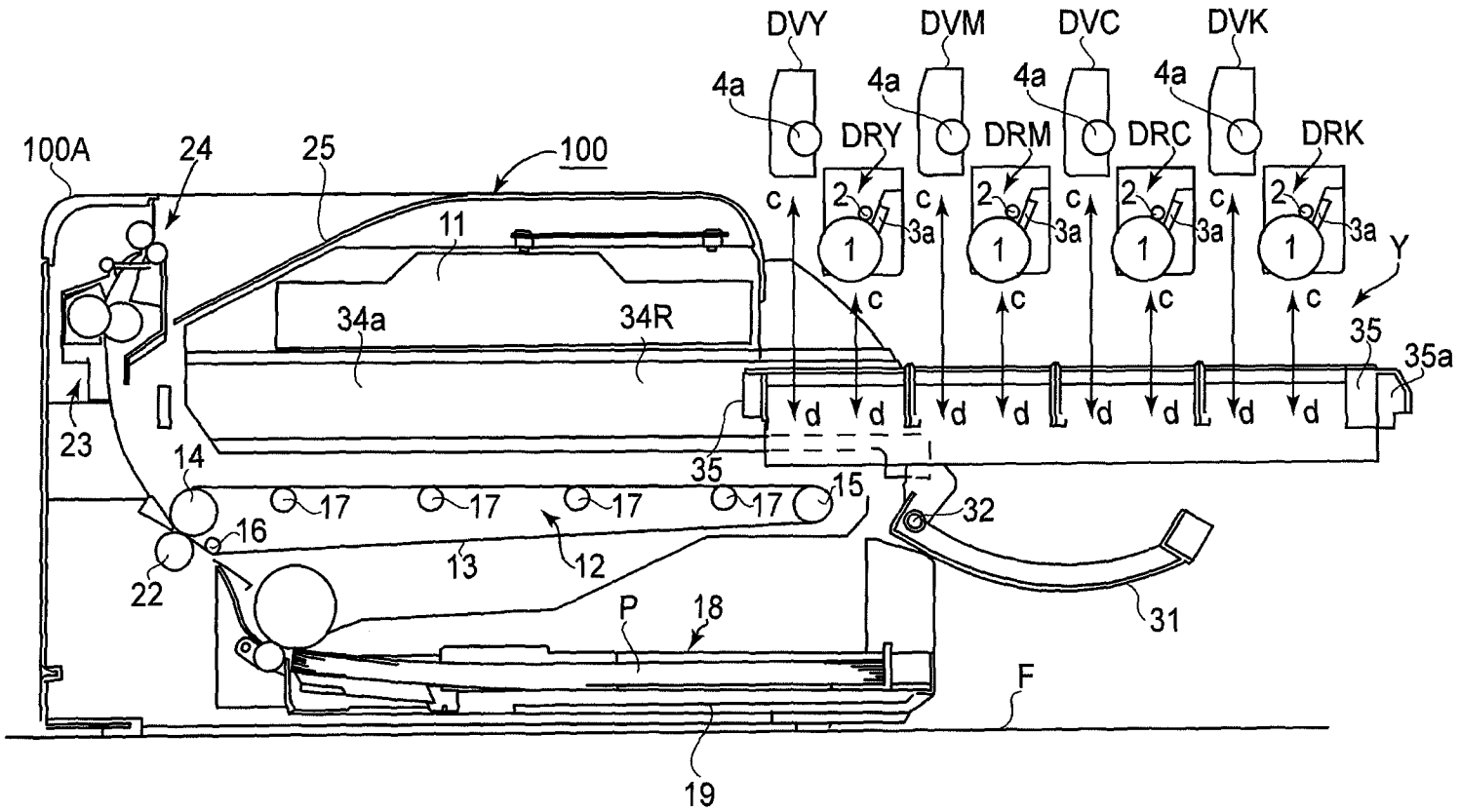
FIG. 4A is a longitudinal left side view of the image forming apparatus in a state in which developing cartridges and drum cartridges are demounted from the tray.
Figure 4B:
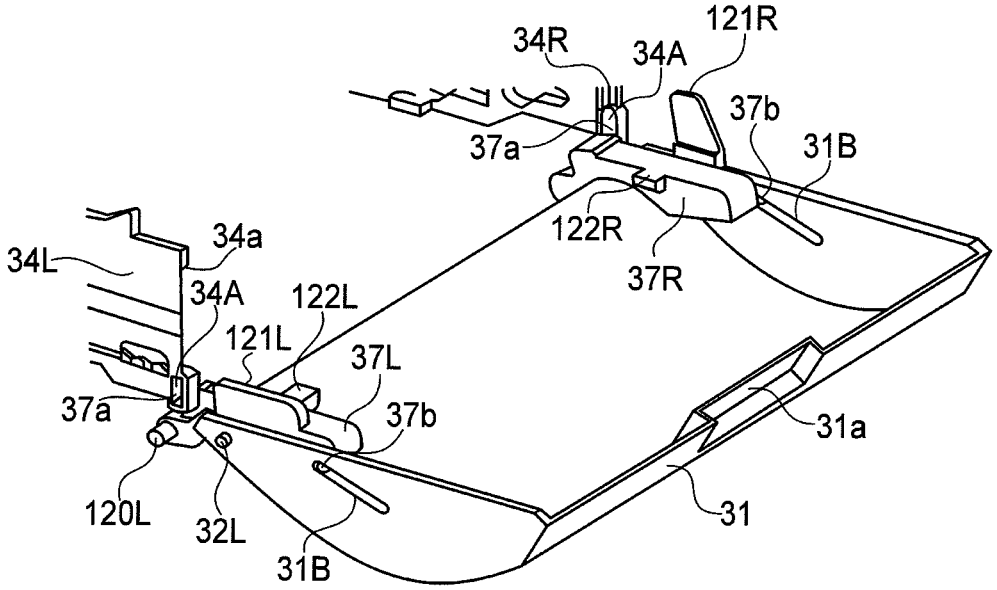
FIG. 4B is a perspective view showing an interrelating mechanism for interrelating the front door and a tray holding member.

In the state in which the tray 35 is pulled out to the outside position Y (FIGS. 3(*a*) and 3(*b*), the tray 35 supports each of the cartridges DV and DR so as to be upwardly demountable from the tray 35 (in a direction of an arrow c shown in FIG. 4B). Further, the tray 35 supports each of the cartridges DV and DR by moving each cartridge DV downwardly from above the tray 35 (in a direction of an arrow d shown in FIG. 4A). Further, when each of the cartridges DV and DR is demounted from the tray 35, the user raises and pulls out each of the cartridges DV and DR from the tray 35. In this case, as shown in FIG. 4A, with respect to the pair of the cartridge DR and the cartridge DV, the cartridge DR and the cartridge DV have no mutual interference portion in an exchange locus of each of the cartridges DR and DV. The exchange locus means a movement locus of each of the cartridges DR and DV when the cartridge is mounted in and demounted from the tray 35. That is, the cartridge DR is provided, in a state in which the cartridge DR is supported by the tray 35, so that the drum 1 is exposed over a full length thereof with respect to its longitudinal direction on a side on which the cartridge DR opposes the cartridge DV. Further, the drum 1 is protruded from the cartridge DR toward the cartridge DV in a direction perpendicular to the drum 1 (FIG. 7(*a*)).

Figure 19:
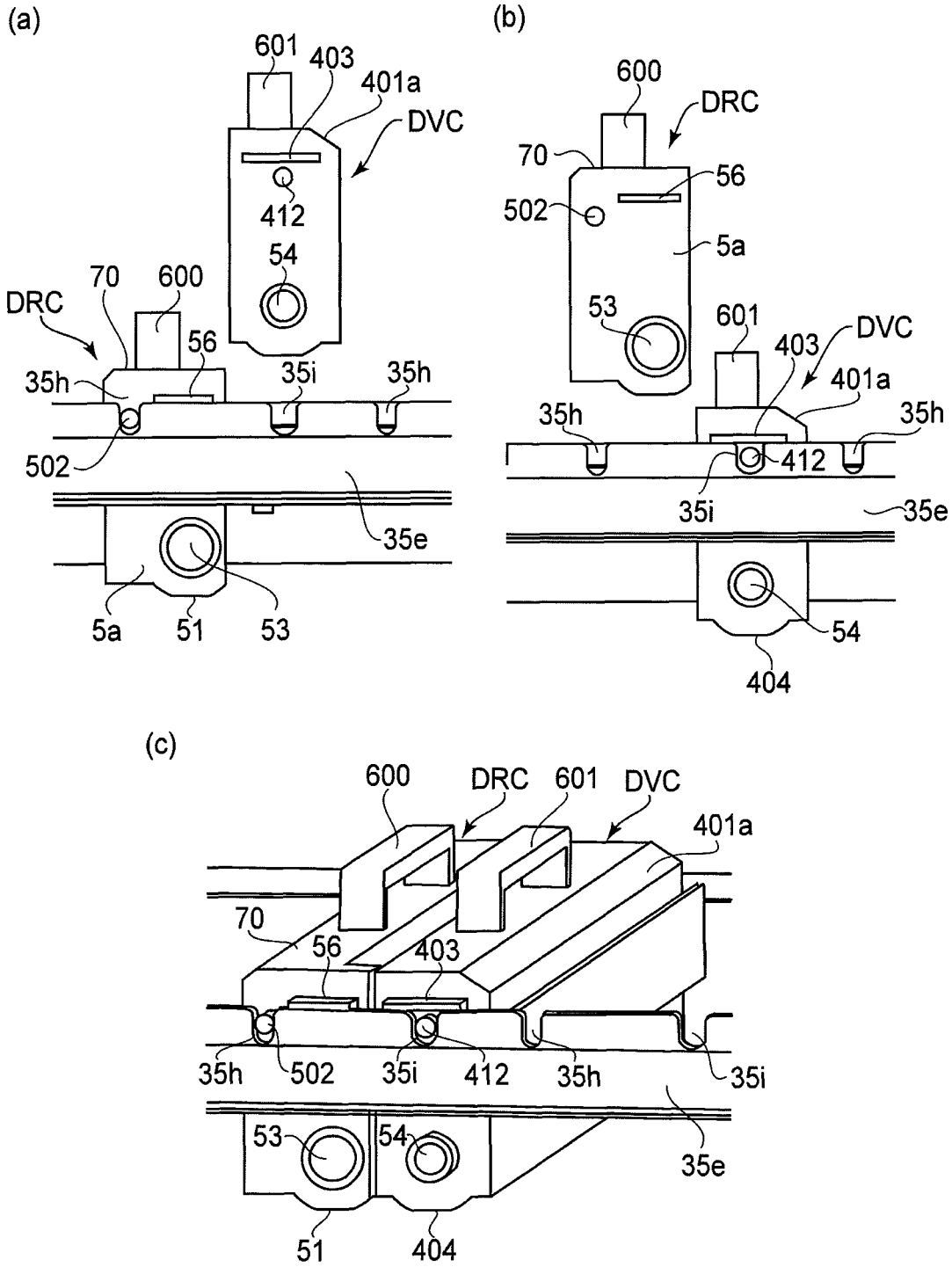
FIGS. 19(*a*) and 19(*b*) are schematic views for illustrating that the drum cartridge and the developing cartridge can be mounted in the tray even when either one of these cartridges is mounted first, and FIG. 19(*c*) is a perspective view of the drum cartridge and the developing cartridge mounted in the tray.

Further, the cartridge DV is provided, in a state in which the cartridge DR is supported by the tray 35, so that the developing roller 4*a* is exposed over a full length thereof with respect to its longitudinal direction on a side on which the cartridge DV opposes the cartridge DR. Further, the developing roller 4*a* is protruded from the cartridge DV toward the cartridge DR in a direction perpendicular to the developing roller 4*a* (FIG. 7(*b*)). Therefore, in a state in which the drum 1 and the developing roller 4*a* are separated from each other, the movement loci of the cartridges DR and DV do not interfere with each other. For this reason, when the cartridges DV and DR are replaced (mounted in and demounted from the tray 35), only the cartridges DV and DR to be exchanged can be replaced without being subjected to control of exchange order. That is, when the user engages and places a fresh cartridge DV or DR in the tray 35 from above, similarly as in the case of the demounting, the cartridge DR and the cartridge DV can be placed in (supported by) the tray 35 even in any mounting order. In FIGS. 19(*a*) to 19(*c*), a state in which the cartridges DR and DV can be mounted in or demounted from the tray 35 even when either one of the cartridges DR and DV is mounted or demounted first. Incidentally, when the user performs the above-described operation, the user may only be required to hold a holding portion G1 or G2 (FIGS. 7(*a*), 7(*b*) and 8(*a*)) or a holding portion 600 or 601 (FIGS. 19(*a*), 19(*b*) and 19(*c*)). When the tray 35 is located at the outside position Y, the cartridges DR and DV can be independently demounted upward from the tray 35. Further, by dropping each of the cartridges DR and DV from above toward the tray 35, the cartridge DR is provided, in a state in which the cartridge DR is supported by the tray 35, so that the drum 1 is exposed over a full length thereof with respect to its longitudinal direction on a side on which the cartridge DR opposes the cartridge DV. Further, the drum 1 is protruded from the cartridge DR toward the cartridge DV in a direction perpendicular to the drum 1 (FIG. 7(*a*), and cartridges DR and DV can be independently mounted in the tray 35. In this case, the mounting of the cartridges DR and DV can be performed in any order.

At the outside position Y, the tray 35 facilitates demounting of all the sets (pairs) of the cartridges DR and DV. As described above, when the exchange of the cartridge with respect to the pulled-out tray 35 is completed, the user sufficiently pushes the tray 35 into the apparatus main assembly 100A along the supporting members 34L and 34R until the tray 35 is received by the stopper portion (not shown). An arrow b shown in FIG. 3(*a*) represents a pushing-in direction of the tray 35. Then, the user closes the opened door 31. That is, the tray 35 is movable between an inside position X located inside the main assembly 100A and the outside position Y located outside the main assembly 100A. The inside position X is a position in which the cartridges DR and DV are positioned at a latent image forming position (image forming position). The outside position Y is the position in which the mounting and demounting of the cartridges DR and DV are performed. Interrelation with the closing rotational movement of the door 31, the supporting members 34L and 34R are moved rearward and downward from the position shown in FIGS. 2(*a*) and 2(*b*) by a predetermined distance. As a result, the tray supporting members 34L and 34R are returned to the position in which their front-side portion enters the inside of the main assembly 100A through the opening 30 by a predetermined distance. By the above-described movement of the tray supporting members 34L and 34R, the tray 34 is returned to the latent image forming position (image forming position or inside position) X. Here, the latent image forming position X refers to a position of the tray 35, located inside the main assembly 100A, for positioning the cartridges DR and DV at the image forming position. Then, the tray 35 is placed in a state in which the tray 35 is prevented from being moved relative to the main assembly 100A by the tray movement preventing means (described later). Further, in interrelation with the above-described movement of the supporting members 34L and 34R, a positioning means (described later) relative to the cartridges DR and DV operates. As a result, the cartridge DR is kept in a state in which the cartridge DR is fixed at a predetermined positioning portion (described later) inside the main assembly 100A. Further, as described later, transmission of a driving force between the main assembly 100A and the cartridges DR and DV is performed.

As described above, the tray 35 is provided movably in a direction intersecting the shaft direction of the drum 1 of the cartridge DR. Further, the tray 35 passes through the opening 30 and can be moved to the outside position Y in which the cartridges DR and DV can be mounted in and demounted from the tray 35 outside the apparatus main assembly 100A. Further, the tray 35 passes through the opening 30 from the outside of the main assembly 100A toward the inside of the main assembly 100A and can be moved to the inside position (latent image forming position or image forming position) X in which the cartridges DR and DV can be located at the position in which the electrostatic latent image is formed on the drum 1. The position in which the electrostatic latent image is formed on the drum 1 means the image forming position described above. In this embodiment, at the inside position X, the drum 1 contacts the belt 13. Further, the supporting members 34L and 34R move, in interrelation with the opening operation of the door 31, the tray 35 upward from the inside position X before the tray 35 is moved to the outside position Y. On the other hand, in interrelation with the closing operation of the door 31, the supporting members 34L and 34R move the tray 35 toward the inside position X in a downward direction. That is, the supporting members 34L and 34R are movable, in a state in which they support the tray 35, between a first position in which the tray 35 is movable between the outside position (pull-out position) Y and the inside position X and a second position for permitting the positioning of the tray 35 at the inside position X. Further, in interrelation with the closing of the door 31 (an interrelating mechanism will be described later), the supporting members 34L and 34R are moved from the first position to the second position. The inside position X refers to a position in which the tray 35 is located inside the main assembly 100A and the door 31. In other words, the inside position X refers to a position in which the tray 35 is located inside the main assembly 100A while supporting at least one pair of the cartridges DR and DV and in which the pair of cartridges DR and DV is located at the image forming position.

(Interrelating Means Between Door 31 and Supporting Members 34L and 34R and Tray Movement Preventing Means)

The interrelating means between the door 31 and the supporting members 34L and 34R and the tray movement preventing means will be described. FIG. 4B is a perspective view of an interrelating means between the door 31 and the tray supporting members 34L and 34R.

The hinge portions (shafts) 32 (32L and 32R) of the door 31 are horizontally provided with respect to the left-right direction of the main assembly 100A. These hinge portions 32 are rotatably supported at both end portions thereof between shaft-supporting members (not shown) provided on the main assembly 100A. These shaft-supporting members may also be left and right frames 80L and 80R (FIG. 2(*a*)).

Further, at both end portions of the door 31, connecting arms 37L and 37R are disposed. Hinge portions 120L and 120R (which is not shown) of the arms 37L and 37R are horizontally disposed with respect to the left-right direction of the main assembly 100A. These hinge portions are rotatably supported by shaft-supporting members (not shown) provided on the main assembly 100A, respectively. These shaft-supporting members may also be the left and right frames 80L and 80R. Each of the arms 37L and 37R is provided with shafts 37*a* and 37*b*. The shaft 37*a* of the arm 37L is engaged in a vertically elongated hole 34A provided in the bottom front portion of the supporting member 34L. Further, the shaft 37*b* of the arm 37L is engaged in a groove 31B provided in the left side surface portion of the door 31. The shaft 37*a* of the right connecting arm 37R is engaged in a vertically elongated hole 34A provided in the bottom front portion of the tray supporting member 34R. Further, the shaft 37*b* of the arm 37R is engaged in a groove 31B provided in the right side surface portion of the door 31. Thus, the door 31 and the supporting members 34L and 34R are connected to each other via the arms 37L and 37R, the shafts 37*a* and 37*b*, the vertically elongated holes 34A, and the grooves 31B. As a result, when the door 31 is opened and closed, a moving force in the front-rear direction acts on the tray supporting members 34L and 34R.

Incidentally, the hinge portions 120L and 120R of the arms 37L and 37R may also be disposed coaxially with the hinge portions 32L and 32R of the door 31. Further, without providing the arms 37L and 37R, the door 31 and the supporting members 34L and 34R may also be directly connected to each other.

Description will be made with reference to FIGS. 5(*a*), 5(*b*) and 5(*c*) and FIGS. 6(*a*) and 6(*b*). Each of the supporting members 34L and 34R is provided with two pins 34*c* which are disposed with a spacing with respect to the front-rear direction. These pins 34*c* are engaged in guide holes 36 provided in the main frames 80L and 80R of the main assembly 100A. By the engagement of each pin 34*c* in a corresponding guide hole 36, the supporting members 34L and 34R are supported by the frames 80L and 80R, respectively.

Figure 5:
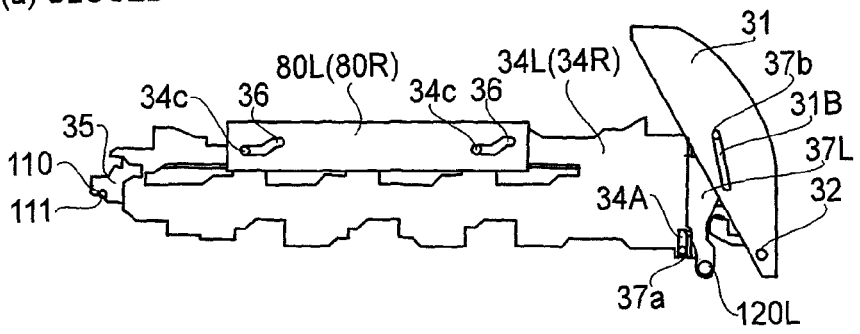
FIGS. 5(*a*), 5(*b*) and 5(*c*) are schematic views for illustrating an interrelation state between opening/closing of the front door and the tray holding member.
Figure 5:
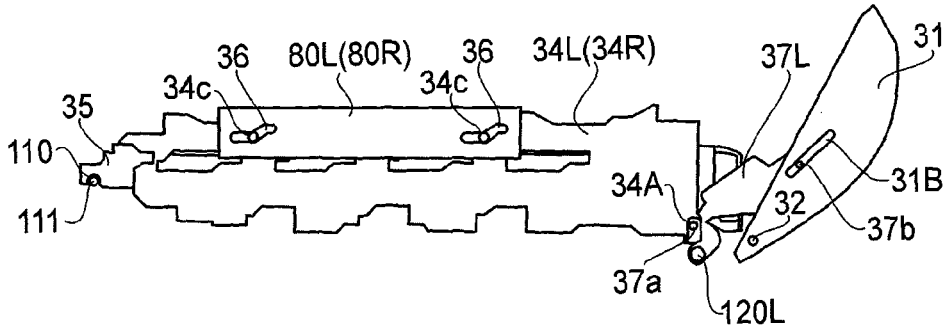
Figure 5:
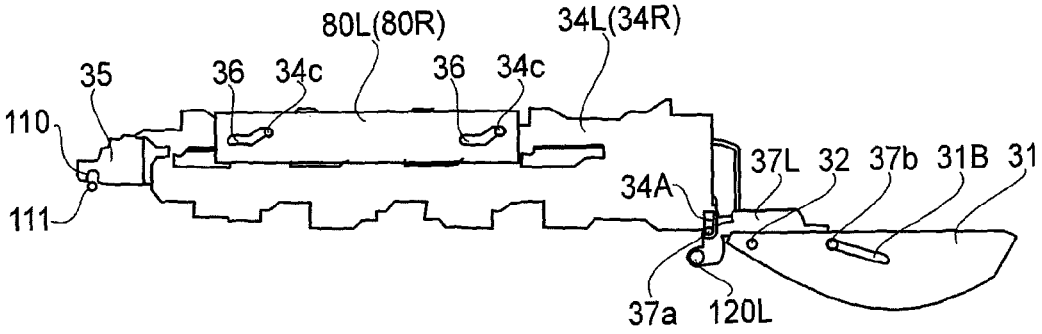

Each of FIGS. 5(*a*), 5(*b*) and 5(*c*) shows the two pins 34*c* of the left holding member 34L, and the guide holes 36 of the left frame 80L. Although those for the right supporting member 34R and the right frame 80R are omitted from illustration, similarly as in the case of the left side, the pins 34*c* and the corresponding guide holes 36 are symmetrically constituted with respect to those on the left side.

Therefore, the supporting members 34L and 34R have such a latitude that the members are movable relative to the left and right frames 80L and 80R within a guide range of the guide holes 36.

Figure 6:
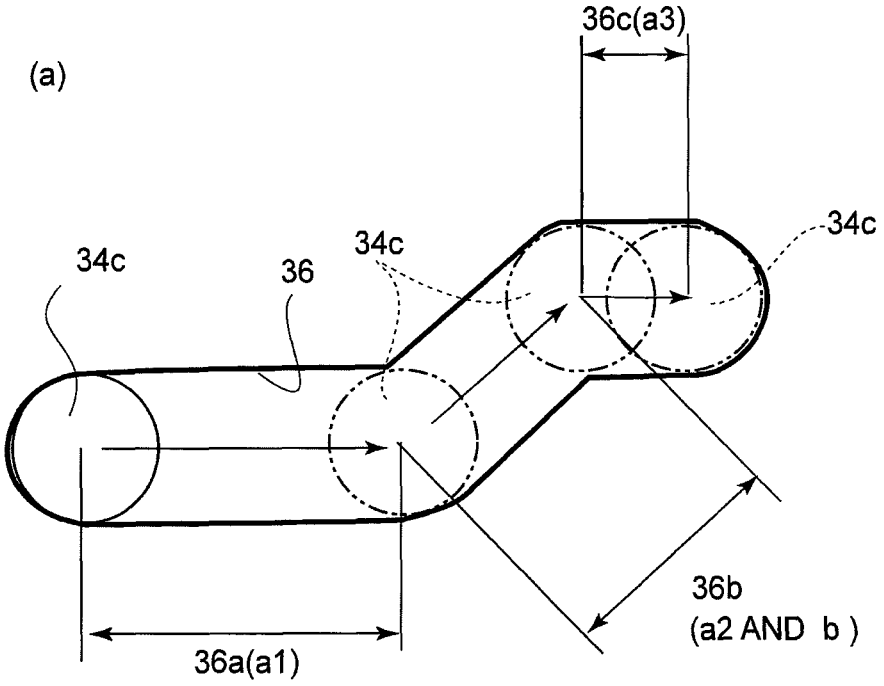
FIG. 6(*a*) is an enlarged view of a guide hole portion for guiding movement of the tray holding member, and FIG. 6(*b*) is an enlarged view of a pin and U-shaped groove as a tray movement preventing means.
Figure 6:
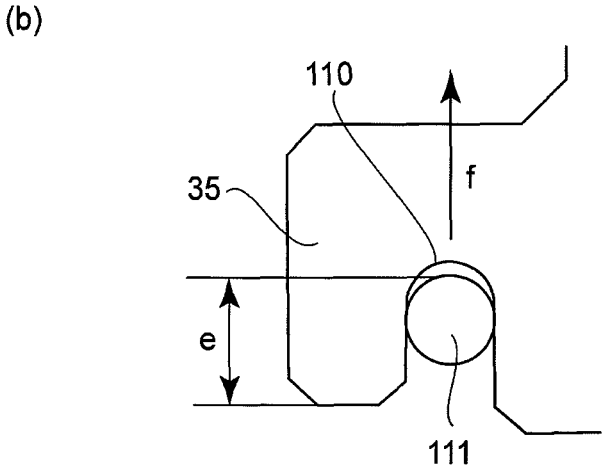

FIG. 6(*a*) is an enlarged view of one of the guide holes 36. Each guide hole 36 includes first, second, and third guiding sections 36*a*, 36*b*, and 36*c*. The first guiding section 36*a* is a horizontal section parallel to the front-rear direction. The second guiding section 36*b* extends frontward from the front end of the first section 36*a*, slanting upward. The third guiding section 36*c* extends horizontally frontward from the front end (top portion) of the second guiding section 36*b* and can stop and stably hold the pin 34*c*.

The pins 34*c*, i.e., the supporting members 34L and 34R are moved by a distance a1, in interrelation with the opening of the door 31, in the horizontal direction along the first guiding section 36*a*, and then are moved slantingly upward (in the horizontal direction by a distance a2 and in a vertical direction by a distance b) along the second guiding section 36*b*. Then, finally, they are moved in the horizontal direction by a distance a3 along the third guiding section 36*c*.

FIG. 5(*a*) shows a state in which the door 31 is sufficiently closed against the opening 30 of the apparatus main assembly 100A. In this state, the supporting members 34L and 34R have been moved rearward in the apparatus main assembly 100A via the hinge shafts 32, the connecting arms 37L and 37R, the shafts 37*a*, and the vertically elongated holes 34*b*. Further, each pin 34*c* is located at the rear end of the first guiding section 36*a* of the guide hole 36. Therefore, the supporting members 34L and 34R are kept at a predetermined lower position (the above-described second position) with respect to the frames 80L and 80R. The tray 35 which is held by the supporting members 34L and 34R is supported at a predetermined lower position (the above-described inside position X).

Each cartridge DR supported by the tray 35 is elastically urged by an urging member 42 main assembly-side process cartridge urging member) at its driving-side upper surface portion with respect to its longitudinal direction. As a result, with respect to each cartridge DR, as described later, lower surface portions (portions to be positioned or first process cartridge-side portions to be positioned) 51 of a driving-side shaft supporting portion 60 and a non-driving-side shaft supporting portion 60 are positioned on stay members (inner side plates) of the main assembly 100A. That is, each cartridge DR is positioned at main assembly-side positioning portions (first main assembly-side process cartridge positioning portions 41Y2, 41M2, 41C2 or 41K2) (FIG. 10B) provided on the stay members (inner side plates) of the main assembly 100A. In other words, each cartridge DR is kept (fixed) in a positioned state relative to the main assembly 100A. Incidentally, the lower surface portions 51 are provided at the lower surface of a frame DR1 and are provided coaxially with the axial (shaft) line of the drum 1 (FIG. 7(*a*)). As a result, the cartridge DR can be positioned in the main assembly 100A with the drum 1 as its positioning center. The main assembly-side positioning portions 41Y2, 41M2, 41C2 and 41K2 are the first main assembly-side process cartridge positioning portions, provided in the main assembly 100A, for positioning the cartridges DR in the main assembly 100A. Further, the urging members 42 are provided in the main assembly 100A so that the lower surface portions (the first process cartridge-side portions to be positioned) 51 of the cartridges DR are urged against the positioning portions 41Y2, 41M2, 41C2 and 41M2 in the state in which the tray 35 is located at the inside position X.

In this state, the lower surface of each drum 1 stably contacts the upper surface of the belt 13. Each cartridge DV is also kept in the positioned state by positioning means (described below). That is, lower surface portions (portions to be positioned) 404 of a driving-side shaft supporting portion 61 and a non-driving-side shaft supporting portion 61 are positioned in the main assembly 100A. That is, each cartridge DR is positioned at main assembly-side positioning portions (first main assembly-side developing cartridge positioning portions 41Y1, 41M1, 41C1 or 41K1) (FIG. 10B) provided on the stay members (inner side plates) of the main assembly 100A. Incidentally, the lower surface portions 404 are provided at the lower surface of a frame DV1 and are provided coaxially with the axial (shaft) line of the developing roller 4*a* (FIG. 7(*b*)). As a result, the cartridge DV can be positioned in the main assembly 100A with the developing roller 4*a* as its positioning center. The main assembly-side positioning portions 41Y1, 41M1, 41C1 and 41K1 are the first main assembly-side developing cartridge positioning portions, provided in the main assembly 100A, for positioning the cartridges DV in the main assembly 100A in the state in which the tray 35 is located at the inside position X.

In this state, in drive input portions (coupling engaging portions) 53 and 54 of the cartridge DR and the cartridge DV, drive output portions (a drum drive coupling 39 and a development drive coupling 40) of the main assembly 100A are engaged, respectively. On the right side of the tray 35, a downward U-shaped groove 110 is provided. A lower end portion (portion to be prevented from being moved) of the U-shaped groove 110 engages with a pin 111 (a movement preventing member or a stationary member) provided on the frame 80R of the apparatus main assembly 100A to be positioned (movement of the tray is prevented) (FIG. 5(*a*)).

FIG. 5(*b*) shows a state in which the door 31 is partly opened. As the door 31 placed in the closed state as shown in FIG. 5(*a*) is opened, the supporting members 34L and 34R are pulled frontward in the main assembly 100A in interrelation with the opening of the door 31. As a result, the supporting members 34L and 34R are first moved frontward by the distance a1, since the pins 34*c* are guided by the first guiding section 36*a* (FIG. 6(*a*)) of the guide hole 36. FIG. 5(*b*) shows this state. During the moving process of the supporting members 34L and 34R by the distance a1, the drum drive couplings (drive output portions) 39 are disengaged from the coupling engaging portions (drum drive input portions) 53. Further, the development drive couplings (development drive output portions) 40 are disengaged from the coupling engaging portions (development drive input portions) 54. Further, the urging positioning of each cartridge DR by the urging member is released. At this time, the pin 111 provided on the frame 80 is engaged in the U-shaped groove 110 to be positioned so that the tray 35 is prevented from following the above-described movement of the supporting members 34L and 34R. That is, the tray 35 is prevented from moving relative to the main assembly 100A. Then, in interrelation with the further opening operation of the door 31, the supporting members 34L and 34R are pulled frontward further in the apparatus main assembly 100A. As a result, the supporting members 34L and 34R move in the slanting upward direction, with the pins 34*c* being guided by the second guiding section 36*b* of the guiding hole 36. Referring to FIG. 6(*b*), a distance by which the pin 111 enters U-shaped groove 110 is taken as e. Further, a distance by which the U-shaped groove 110 is vertically displaced by the movement of the supporting members 34L and 34R in the slantingly upward direction is taken as f. During this slantingly upward movement of the supporting members 34L and 34R, as long as the U-shaped groove (portion to be prevented from being moved) 110 is engaged with the pin (movement preventing member) 111 (e>f), the U-shaped groove 110 follows only the movement of the supporting members 34L and 34R in the vertical direction. Then, in a state in which the supporting members 34L and 34R are displaced upward to a certain degree (e<f), the pin 111 comes out of the U-shaped groove 110. By employing such a constitution, in a state in which the lower surface of each drum 1 supported by the tray 35 is in contact with the belt 13, the tray 35 does not horizontally move. Therefore, it is possible to prevent occurrences of damage and memory caused by friction between the drum 1 and the belt 13.

FIG. 5(*c*) shows a state in which the door 31 is sufficiently opened. In this state, the supporting members 34L and 34R have finished their slantingly upward movement effected by the second guiding section 36*b*, so that the pins 34*c* are located in the horizontal third guiding section 36*c*. That is, the supporting members 34L and 34R are horizontally moved after the slantingly upward movement. This is because the cartridges DR and DV and the supporting members 34L and 34R can be kept stably at a position with respect to the vertical direction and the supporting members 34L and 34R can be prevented from being moved and returned to the original position during the exchange of the cartridges DR and DV by pulling out of the tray 35 from the supporting members 34L and 34R.

In the state shown in FIG. 5(*c*), the pin 111 has already come out of the U-shaped groove 110, so that the positioning state of the tray 35 is released (release if tray movement prevention).

Therefore, the tray 35 is slidably movable horizontally in the front-rear direction relative to the supporting members 34L and 34R.

The operation in the case where the door 31 placed in the opened state is closed is the reverse of the above-described operation. Here, the above-described groove (portion to be prevented from being moved) 110 and the pin (movement preventing member) 111 constitute a movement preventing means for preventing the tray, at the inside position (mounting) position in the main assembly 100A, from moving in a direction intersecting a direction in which each drum 1 and the belt 13 contact each other. This prevention of the movement of the tray 35 by the movement preventing means (the groove 110 and the pin 111) is released after the tray 35 follows the movement of the supporting members 34L and 34R in the contact direction in which the drum 1 and the belt 13 contact each other.

The supporting members 34L and 34R are guided along the first guiding section 36*a* to move in the direction intersecting the direction in which the drum 1 and the belt 13 contact each other (first movement). Then, the supporting members 34L and 34R are guided along the section 36*b* to move in the standing upward direction including two directional components consisting of the direction in which the drum 1 and the belt 13 contact each other and the direction intersecting the contact direction (second movement). Thereafter, the supporting members 34L and 34R move in the direction intersecting the direction in which the drum 1 and the belt 13 contact each other (third movement).

The supporting members 34L and 34R disconnect the driving means for each cartridge DR during the first movement and the tray 35 follows the movement of the supporting members 34L and 34R in the directional component in which the drum 1 and the belt 13 contact each other, and thereafter the above-described movement preventing means 110 and 111 are disengaged. The operation in the case where the door 31 placed in the opened state is closed is the reverse of the above-described operation.

(Drum Cartridge Dr and Developing Cartridge DV)

Figure 7:
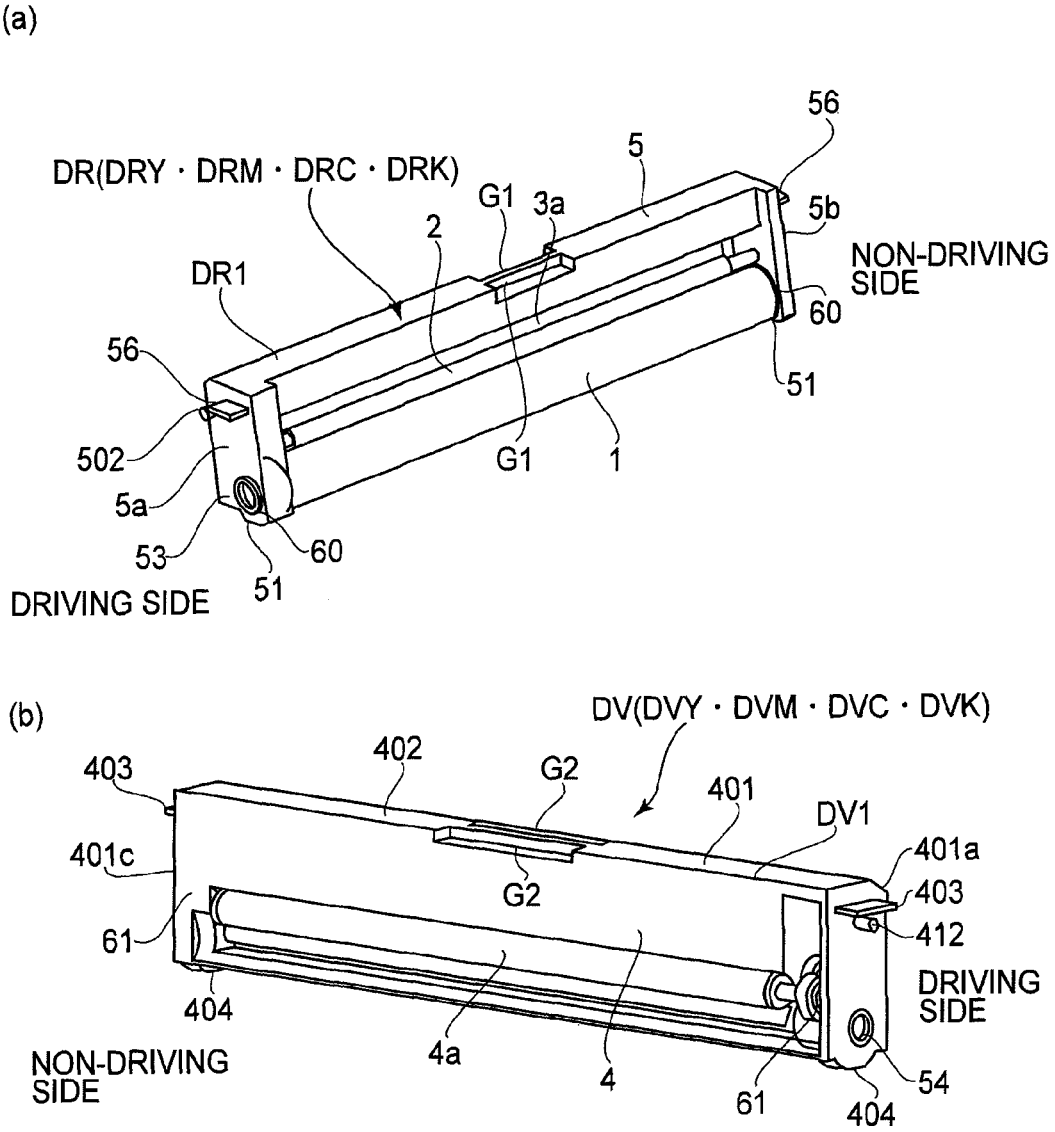
FIG. 7(*a*) is a perspective view of an outer appearance of the drum cartridge, and FIG. 7(*b*) is a perspective view of an outer appearance of the developing cartridge.

FIG. 7(*a*) is a perspective view of each drum cartridge DR as seen from the driving side (right side of the cartridge).

The cartridge DR is a box-type assembly extending in the axial direction of the drum 1 as its longitudinal direction. The drum 1 is rotatably supported, in the drum cartridge frame 5, between the shaft supporting portions 60 and 60 provided at inner surfaces of side surface portions 5*a* and 5*b* on the driving side and on the non-driving side (left side of the cartridge), respectively (FIG. 7(*a*)). On the shaft supporting portion 60 on the driving side, the coupling engaging portion (drum drive input portion) 53 is provided.

The charging roller 2 is supported rotatably between shaft supporting portions 61 which are similarly provided (FIG. 7(*b*)). The cleaning blade 3*a* is fixed on the frame 5 so that an end thereof contacts the drum 1. At the outer surfaces of the side surface portions 5*a* and 5*b*, flat plate-like eaves (process cartridge-side portions to be supported) 56 extending outward with respect to the longitudinal direction of the cartridge DR are provided. That is, the eave 56 is provided on one end side and the other end side of the drum 1 with respect to the longitudinal direction of the drum 1. The eaves 56 are provided at upper portions of the side surface portions 5*a* and 5*b* in a state in which the cartridge DR is supported by the tray 35. Further, the eaves 56 extend in the pull-out direction a of the tray 35 in the state in which the cartridge DR is supported by the tray 35. The eaves (process cartridge-side portions to be supported) 56 are provided on the cartridge DR in order to permit the support of the cartridge DR by the tray 35.

FIG. 7(*b*) is a perspective view of each cartridge DV as seen from the driving side.

The cartridge DV is a box-type assembly extending in the axial direction of the developing roller 4*a* parallel to the axial direction of the drum 1 as its longitudinal direction. The developing roller 4*a* is rotatably supported, in the developing cartridge frame 401, between shaft supporting portions 61 and 61 provided at inner surfaces of side surface portions 401*a* and 401*b* on the driving side and on the non-driving side, respectively (FIG. 7(*b*)). On the shaft supporting portion 61 on the driving side, the coupling engaging portion (developing device drive input portion) 54 for driving the developing roller 4*a* is provided.

A part of the frame 401 constitutes the developer accommodating container 4 for accommodating the developer. An eave 402 is provided by being extended from a top plate portion of the frame 401 in a widthwise direction. The widthwise direction is perpendicular to the longitudinal direction. At the outer surfaces of the side surface portions 401*a* and 401*b*, flat plate-like eaves (developing cartridge-side portions to be supported) 403 extending outward with respect to the longitudinal direction of the cartridge DV are provided. That is, the eave 403 is provided on one end side and the other end side of the developing roller 4*a* with respect to the longitudinal direction of the developing roller 4*a*. The eaves 403 are provided at upper portions of the side surface portions 401*a* and 401*b* in a state in which the cartridge DV is supported by the tray 35. Further, the eaves 403 extend in the pull-out direction a of the tray 35 in the state in which the cartridge DV is supported by the tray 35. The eaves (developing cartridge-side portions to be supported) 403 are provided on the cartridge DV in order to permit the support of the cartridge DV by the tray 35.

Figure 8:
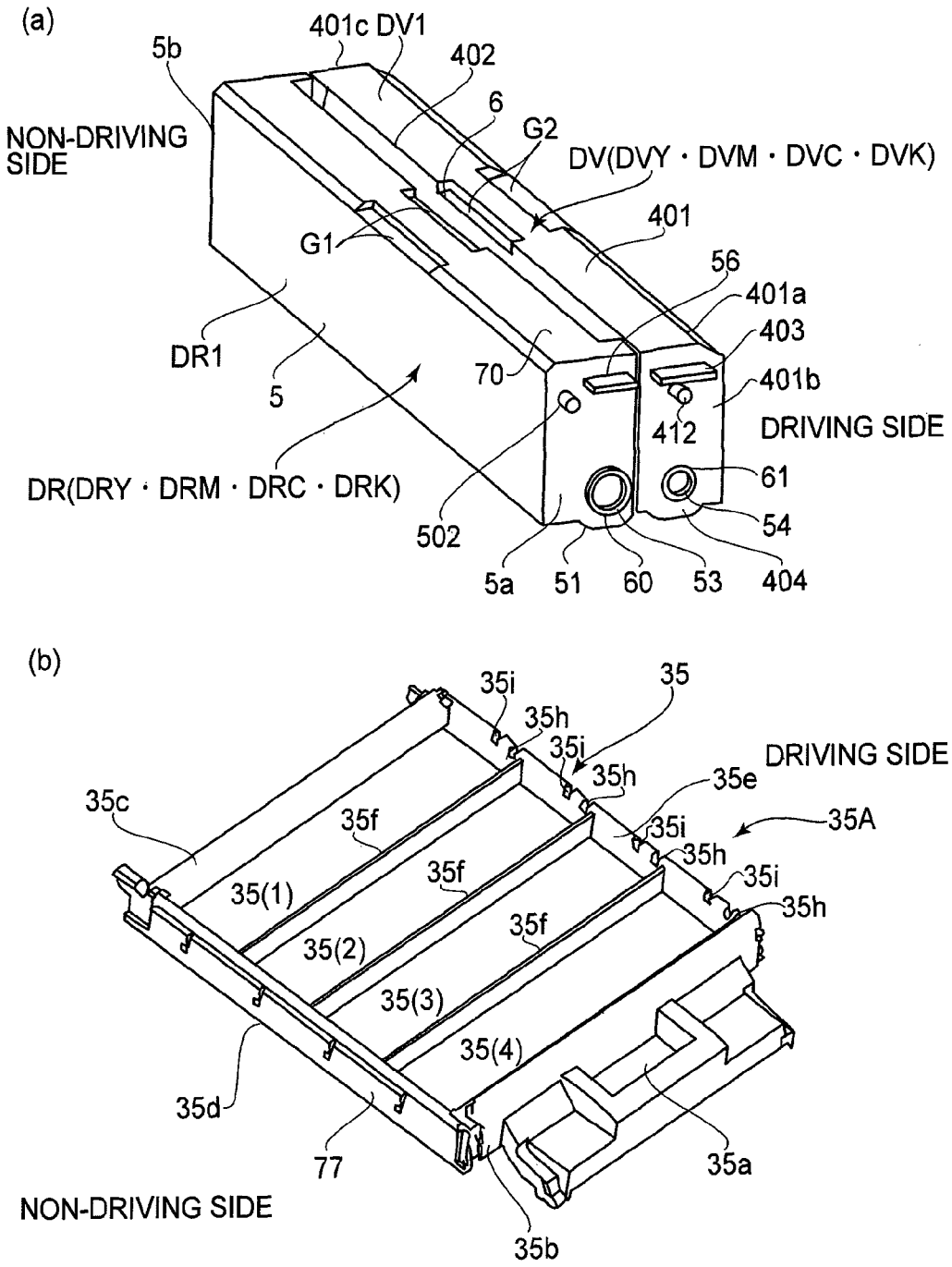
FIG. 8(*a*) is a perspective view of an outer appearance of the drum cartridge and the developing cartridge disposed in combination, and FIG. 8(*b*) is a perspective view of an outer appearance of the tray.

FIG. 8(*a*) is a perspective view showing a state in which a pair (set) of the cartridge DR and the cartridge DV is mounted in an unshown tray 35. The cartridge Dr and DV have no mutual interference portion with respect to the directions in which they are mounted in and demounted from the tray 35 (directions indicated by arrows c and d in FIG. 4A; a vertical direction with respect to the tray 35). For that reason, the cartridges DR and DV can be separately demounted from the tray 35 even when either one of the cartridges DR and DV is demounted first. In addition, during the exchange of the cartridges DR and DV, there is no need to demount screws or parts. Therefore, the user of the image forming apparatus 100 can simply replace the cartridges DR and DV. As a result, the use can simply replace only a cartridge necessary to be exchanged. Therefore, it is possible to improve exchange operativity of the cartridge. That is, when the tray 35 is pulled out to the outside position Y, the cartridges DR and DV can be demounted even when either one of the cartridges DR and DV is demounted first. In the case where the cartridge DR is demounted first, when the cartridge DR is raised, the cartridge DV is rotated about the lower surface portions 404 in a direction in which the cartridge DV is separated from the drum 1. Therefore, even when the drum 1 and the developing roller 4*a* have contacted each other, there is no damage on both of the drum 1 and the developing roller 4*a*. Further, in the case where the cartridge DV is demounted first, when the cartridge DV is raised, the developing roller 4*a* is separated from the drum 1. Therefore, both of the developing roller 4*a* and the drum 1 are not damaged. Further, in the case where the cartridge DR is mounted in the tray 35 in a state in which the cartridge DV is supported by the tray 35, when the drum 1 contacts the developing roller 4*a*, the cartridge DV is rotated about the lower surface portion 404 in a direction in which the cartridge DV is separated from the drum 1. When the cartridge DV is mounted in the tray 35 in a state in which the cartridge DR is supported by the tray 35, the eaves 403 are caused to be supported by the tray 35. In this state, the drum 1 and the developing roller 4*a* contact lightly or separated from each other. Therefore, both of the drum 1 and the developing roller 4*a* are prevented from being damaged.

FIGS. 19(*a*), 19(*b*) and 19(*c*) are schematic views showing that the drum cartridge DR and the developing cartridge DV can be mounted in and demounted from the tray 35 even when either one of the cartridges DR and DV is mounted or demounted first. Incidentally, in this embodiment, an example in which the holding portions 600 and 601 by which the user holds the cartridges DR and DV are projected upward from the upper surfaces of the cartridges is shown. However, the holding portion is not limited thereto. For example, the holding portion may also be a recessed portion provided on one end side and on the other end side of the upper surface of each of the cartridges DR and DV relative to the widthwise direction of the cartridge (FIGS. 7(*a*) and 7(*b*) and FIG. 8(*a*)). In FIG. 7(*a*), a holding portion G1 is shown, and in FIG. 7(*b*), a holding portion G2 is shown.

(Tray 35)

FIG. 8(*a*) is a perspective view of an outer appearance of the tray 35.

This tray 35 includes a rectangular framework portion 35A consisting of a front frame 35*b*, a rear frame 35*c*, a left frame 35*d*, and a right frame 35*e* which are connected to each other. The inside of the framework portion 35A is substantially equally partitioned into four areas by three partitioning plates 35*f* with respect to the front-rear direction of the framework portion 35A. First to fourth small frame portions 35(1) to 35(4) are constituted from the rear frame 35*c* side to the front frame 35*b* side in this order. The small frame portions 35(1), 35(2), 35(3) and 35(4) are supporting portions for holding four sets (pairs) of cartridges DRY and DVY, DRM and DVM, DRC and DVC, and DRK and DVK, respectively. The cartridge set DV and DR are supported by the tray 35 in this order from the upstream side to the downstream side of the pull-out direction a. The cartridge DR is provided with a rotating preventing boss 502 on the side surface 5*a* on the driving side (FIG. 7(*a*) and FIG. 8(*a*)). The boss (second process cartridge-side portion to be positioned) 502 is disposed so as to be located at a position lower than that of the eave 56 with respect to the vertical direction in a state in which the cartridge DR is supported by the tray 35. The boss 502 is provided below the eave 56 in the state in which the cartridge DR is supported by the tray 35, and is constituted so as to be engaged in a groove 35 (second supporting member-side preventing portion) provided relative to the tray 35 with accuracy. As a result, the cartridge DR is positioned in the main assembly 100A with accuracy.

The right frame 35*e* for the small frame portions 35(1) to 35(4) is provided with four U-shaped grooves (second main assembly-side process cartridge positioning portion) 35*h* for the small frame portions 35(1) to 35(4), respectively, and the boss 502 of the cartridge DR is configured to be inserted into each of the grooves 35*h*. That is, the groove 35*h* is provided, every small frame portion 35 of the tray 35, on the right frame 35*e* provided on one end side with respect to a direction perpendicular to the pull-out direction a. Each groove 35*h* prevents the movement of the boss (second process cartridge-side portion to be positioned) 502 of the cartridge DR when the cartridge DR receives from the main assembly 100A a rotational force for rotating the drum 1 in a state in which the tray 35 is located at the inside position X. As a result, each groove (second main assembly-side process cartridge positioning portion) 35*h* prevents the cartridge DR from being rotated about the lower surface portion (first portion to be positioned) 51. Incidentally, the cartridge DR receives the rotational force, for rotating the drum 1, from the main assembly 100A through the coupling 39 and the coupling engaging portion 53.

Figure 9A:
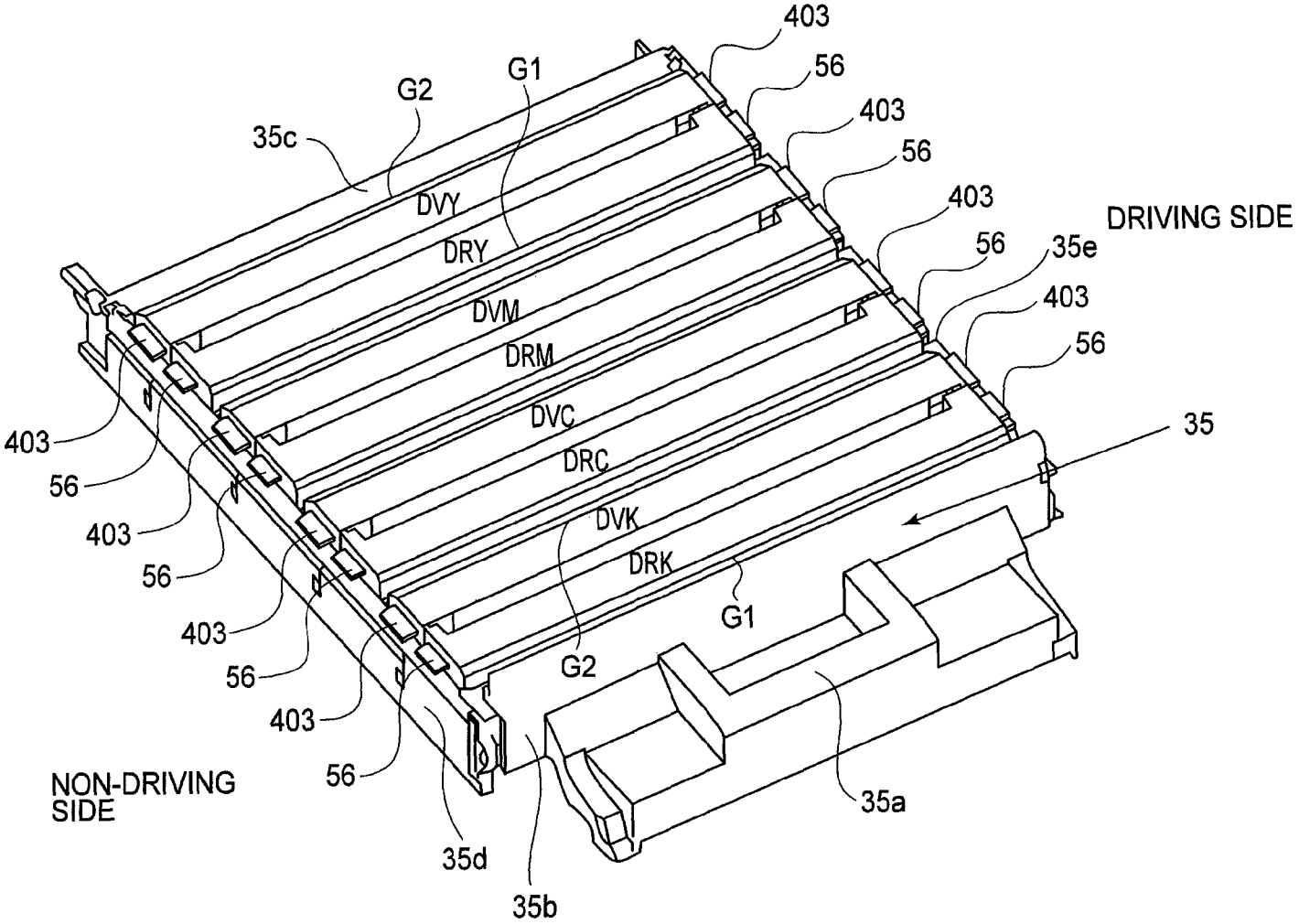
FIG. 9A is a perspective view of an outer appearance of the drum cartridges and the developing cartridges mounted in the tray.

Each of the four cartridges sets DR and DV is inserted from above into an associated one of the small frame portions 35(1) to 35(4) of the tray 35. Then, lower surfaces of the eaves 56 provided on the side surface portions 5*a* and 5*b* of each cartridge DR and lower surfaces of the eaves 403 provided on the side surface portions 401*b* and 401*c* of each cartridge DV are stopped by the upper surfaces of the frames 35*d* and 35*e* of the tray 35. That is, the lower surface of the eave 56 provided on the side surface portion 5*a* is supported by the upper surface of the frame 35*e*, and the lower surface of the eave 56 provided in the side surface portion 5*b* is supported by the upper surface of the frame 35*d*. Further, the lower surface of the eave 403 provided on the side surface portion 401*b* is supported by the upper surface of the frame 35*e*, and the lower surface of the eave 403 provided on the side surface portion 401*c* is supported by the upper surface of the frame 35*d*. As a result, each cartridge DR and each cartridge DV are accommodated in and supported by the tray 35. At this time, the above-described boss 502 is engaged in the groove 35*h* (second supporting member-side preventing portion) with accuracy. Although a width of the groove 35*h* is configured to be somewhat larger than a diameter of the boss (second process cartridge-side portion to be positioned) 502, the engagement between the boss 502 and the groove 35*h* is performed with accuracy. This state is shown in FIG. 9A. That is, the tray 35 supports each cartridge DR and each cartridge DV demountably upward and supports each cartridge DR and each cartridge DV by moving downward each cartridge DR and each cartridge DV. That is, when each of the cartridges DR and DV is mounted in the tray 35, the user moves downward each of the cartridges DR and DV from above. Incidentally, when the cartridges DR and DV are demounted upward, the cartridges may preferably be demounted right above but the present invention is not limited thereto. Further, when the cartridges DR and DV are moved downward, the cartridges may preferably be moved right below but the present invention is not limited thereto. In this state, the tray 35 roughly supports each of the cartridges DR and DV. That is, each of the cartridges DR and DV is movably supported by the tray 35. As a result, the user can easily perform exchange of each of the cartridges DR and DV. The frames 35*d* and 35*e* of the tray 35 are engaged in guide grooves 34*a* (FIGS. 3(*a*), 4A, 4B and 9B) which are provided inside the supporting members 34L and 34R and along the movement direction of the tray 35. As a result, the tray 35 is horizontally slidably moved along the guide grooves 34*a* in the directions indicated by the arrows a and b (FIGS. 3(*a*) and 3(*b*)) while being supported between the tray supporting members 34L and 34R. As described above, the tray 35 includes the supporting portions 35(1) to 35(4) arranged side by side. The tray 35 is movable in a direction intersecting the longitudinal direction of the drum 1 in a state in which the plurality of sets of cartridge DR and cartridge DV are disposed side by side and supported by their supporting portions 35. The tray is movable between the pull-out position (outside position) Y in which the tray 35 is exposed outside the main assembly 100A and the inside position X in which in side the main assembly 100A, the electrostatic latent image can be formed on the drum 1.

(Cartridge Positioning and Coupling Portion)

As described above, the tray supporting members 34L and 34R are moved forward and upward by a predetermined distance in interrelation with the opening movement of the door 31.

Figure 9B:
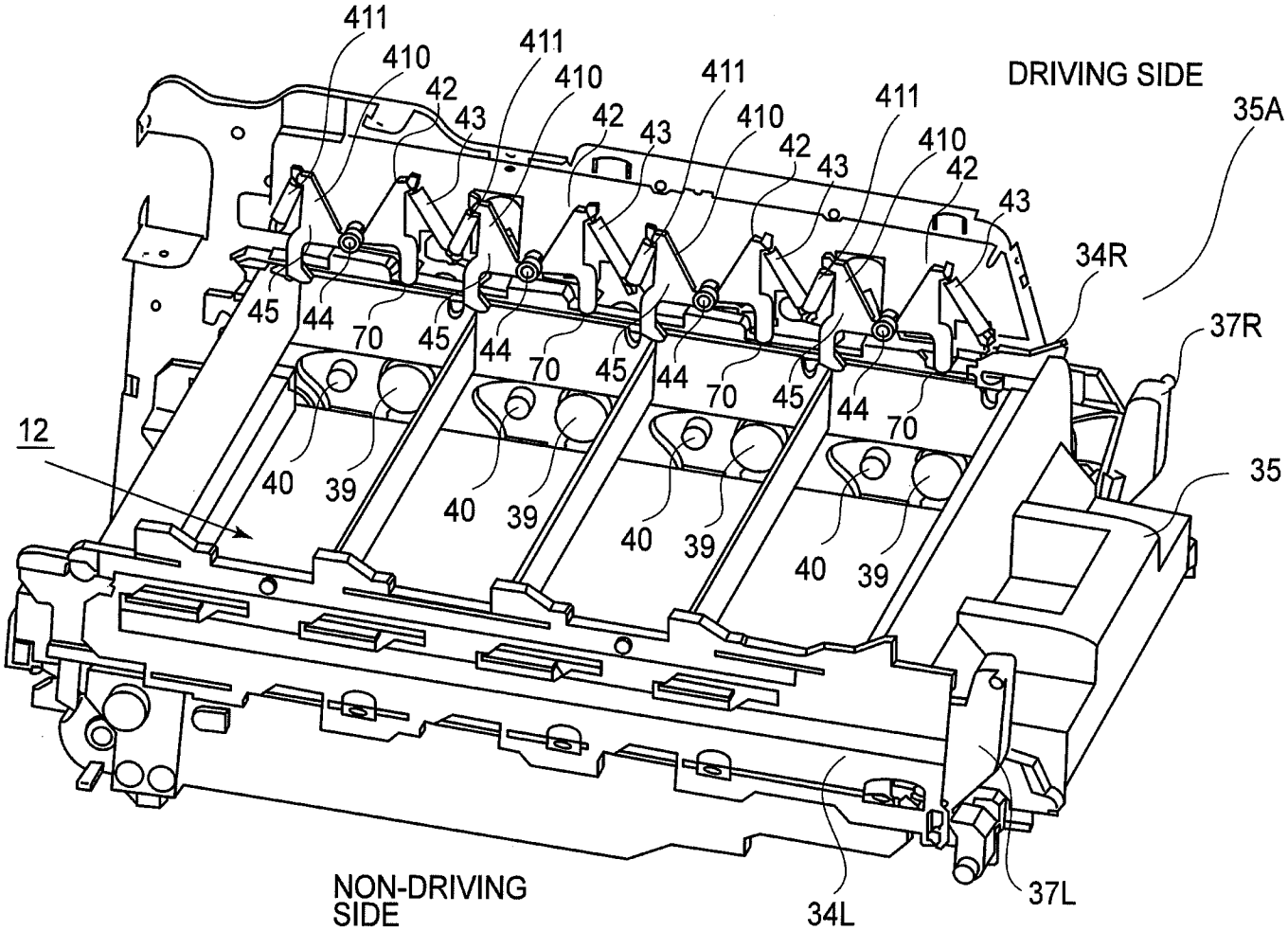
FIG. 9B is a perspective view showing an interface portion, to be located in the neighborhood of the cartridges, in a state in which the tray is inserted.
Figure 10A:
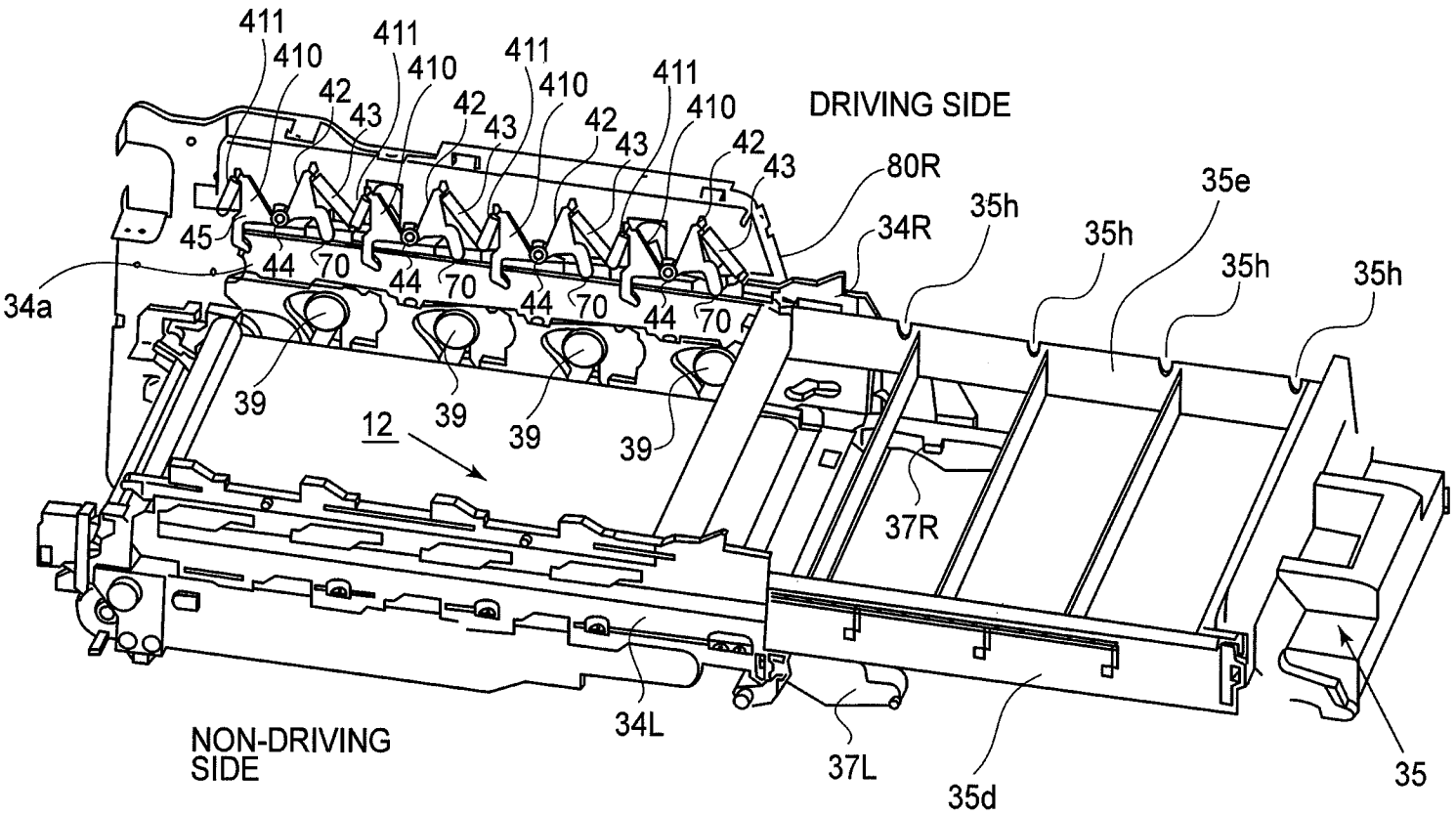
FIG. 10A is a perspective view showing the interface portion, to be located in the neighborhood of the cartridges, in a state in which the tray is pulled out.
Figure 10B:
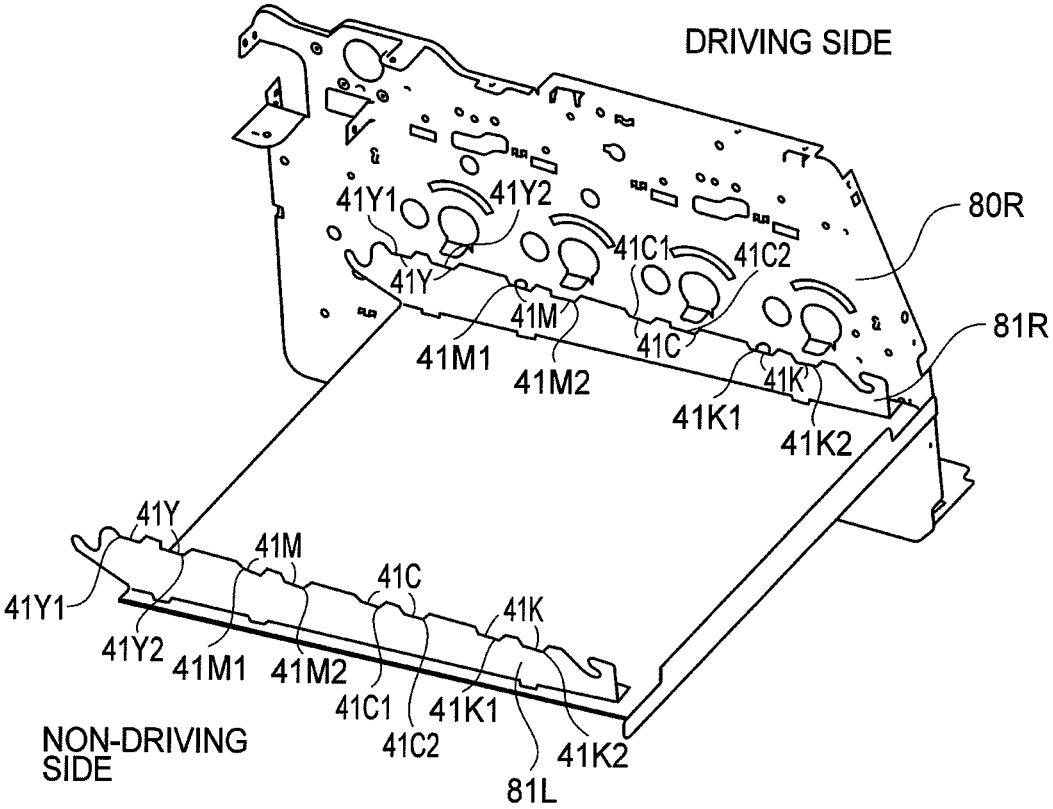
FIG. 10B is a perspective view showing a structure of a stay for positioning the developing cartridges and the drum cartridges.

FIGS. 9B and 10A are schematic views for illustrating interface portions, located in the neighborhood of the cartridges, to be disengaged or released in interrelation with the above-described movement by the predetermined distance. FIG. 9B is a schematic view showing a state in which the door 31 is closed (FIGS. 1A and 1B) in a state in which the cartridges DR and DV are not mounted. FIG. 10A is a schematic view showing a state in which the door 31 is opened and then the tray 35 is pulled out from the main assembly 100A (FIG. 3(*a*) and FIG. 3(*b*)). FIG. 10B is a perspective view for illustrating a constitution of a stay for positioning the cartridges DR and DV in the main assembly 100A. Inside the main assembly 100A, positioning portions (positioning means) 41 (41Y, 41M, 41C and 41K) are provided on stay members 81R and 81L of the main assembly 100A on right and left sides of the main assembly 100A. That is, the positioning portions 41 (41Y, 41M, 41C and 41K) are provided on one end side and the other end side of the cartridges DR and DV with respect to the longitudinal direction of the cartridges and are provided below the cartridges DR and DV located at the inside position X. Incidentally, the positioning portions 41Y, 41M, 41C and 41K receive the lower surface portions 51 of the cartridges DR and receive the lower surface portions 404 of the cartridges DV (FIG. 10B).

The positioning portion 41 receives the lower surface portions 51 of the driving side shaft supporting portion 60 and non-driving side shaft supporting portion 60 of the cartridge DR and receives the lower surface portions of the driving side shaft supporting portion 61 and non-driving side shaft supporting portion 61 of the cartridge DV. Each lower surface portion 51 has an arcuate configuration provided coaxially with the drum 1, and each lower surface portion 404 has an arcuate configuration provided coaxially with the developing roller 4*a*. Further, each positioning portion 41 is a recessed portion and positions an associated one of the lower surface portions 51 and 404 at three points. Therefore, the cartridge DR is positioned in the main assembly 100A at its one longitudinal end and the other longitudinal end with the drum 1 as the center of the positioning. Further, the cartridge DV is positioned in the main assembly 100A at its one longitudinal end and the other longitudinal end with the developing roller 4*a* as the center of the positioning. Further, in this embodiment, in order to engage and fix (position) the lower surface portions 51 in the positioning portions 41 (41Y2, 41M2, 41C2 and 41K2), first urging members (positioning means) 42 for urging the driving side upper surfaces of the cartridges DR are provided. Further, the lower surface portions 404 are engaged and fixed (positioned) in the positioning portions 41 (first main assembly-side developing cartridge positioning portions 41Y1, 41M1, 41C1 and 41K1). For this purpose, second urging members (positioning means main assembly-side developing cartridge urging members) 410 for urging the driving side upper surfaces (inclined surface portions 401*a*) of the cartridges DV are provided.

In order to generate an urging force (elastic force), each urging member 42 is provided with an urging spring (first urging member) 43 and each urging member 410 is provided with an urging spring (second urging member or positioning means) 411. Incidentally, the urging members 42, the urging members 410, the urging springs 43 and the urging springs 411 are provided on driving side one longitudinal end side of the cartridges DR and DV but may also be provided on both longitudinal end sides of the cartridges DR and DV. That is, it is also possible to employ such an apparatus constitution that the non-driving side upper surfaces of the respective cartridges DR and the respective cartridges DV are urged. Incidentally, by providing the above members 42, 410, 43 and 411 on the driving side one end side, vibration generated during the transmission of the driving force can be efficiently alleviated. Therefore, the positioning of the cartridges DR and DV relative to the main assembly 100A can be effected with accuracy. Incidentally, the longitudinal direction of the cartridge DR is equal to the longitudinal direction of the drum 1. Further, the longitudinal direction of the cartridge DV is equal to the longitudinal direction of the developing roller 4*a*.

Figure 11:
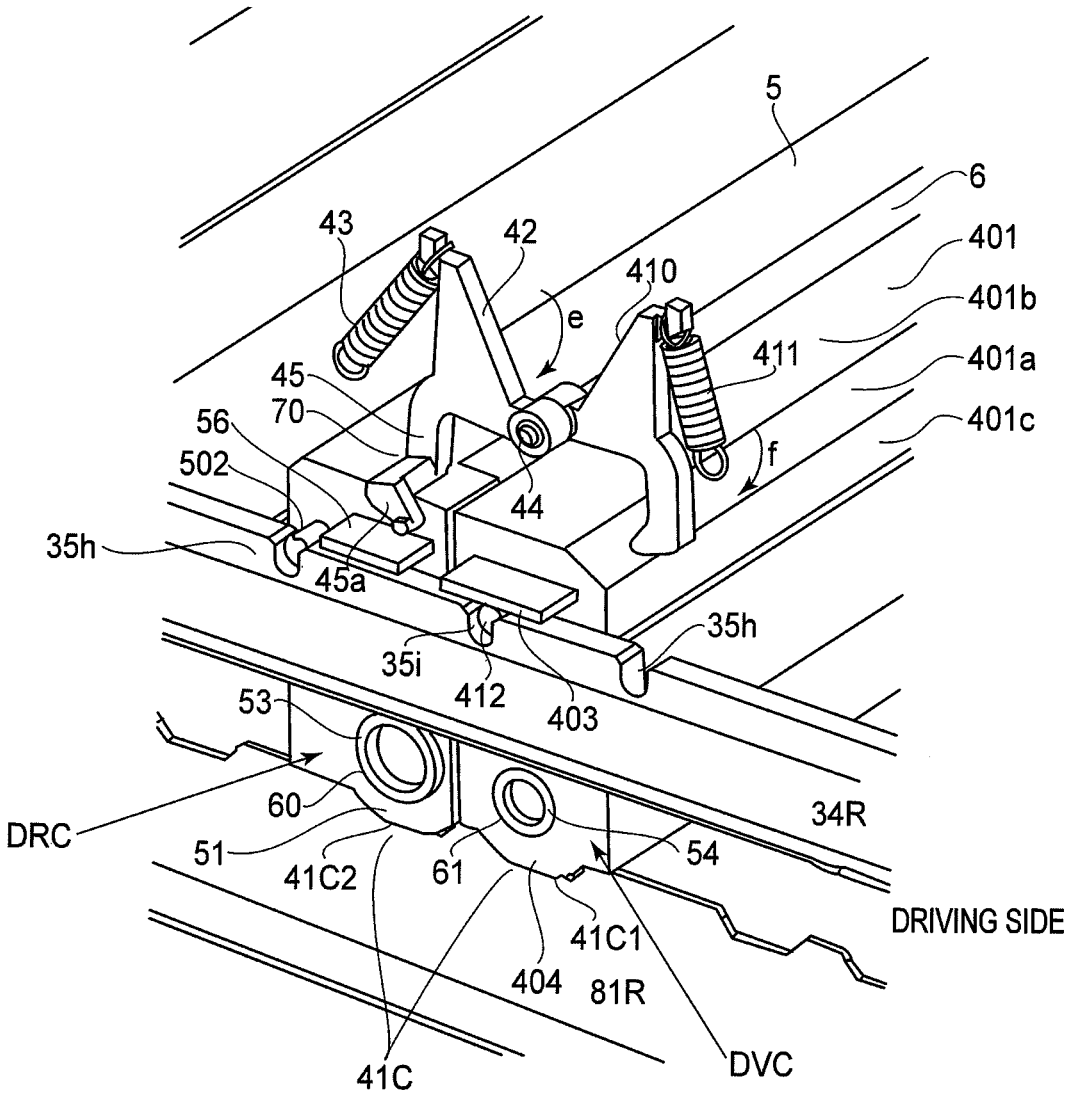
FIG. 11 is a perspective view showing a state in which the developing cartridge and the drum cartridge are positioned in the apparatus main assembly in a state in which the tray is inserted.

FIG. 11 shows a state in which the cartridges DR and DV are mounted in the tray 35 and are accommodated in the main assembly 100A. In order to simplify the figure, with respect to the urging member 42, the urging member 410, the urging spring 43, and the urging spring 411, only those associated with the cartridges DR and DV are illustrated. In the state in which the tray 35 is accommodated in the main assembly 100A, the upper surface of the supporting member 34R is separated from the lower surface of the eave 56 of the cartridge DR and the lower surface of the eave 403 of the DV. The upper surface portion (firsts portion to be urged or process cartridge-side portion to be urged) 70 of the cartridge DRC is urged by an urging force (elastic force, arrow e direction) of the urging member 42. As a result, the lower surface portions 51 of the driving side shaft support portion 60 and the non-driving side shaft supporting portion 60 are urged against and engaged in the positioning portions 41C provided on the main assembly 100A side. That is, the upper surface portion (process cartridge-side portion to be urged) 80 receives from the urging member 42 the urging force for urging the lower surface portions 51 against the positioning portions 41Y2, 41M2, 41C2 and 41K2 in the state in which the tray 35 is located at the inside position X. Further, the boss (portion to be prevented from move) 502 is engaged in the groove (preventing portion) 35*h* provided on the tray 35 side. As a result, the cartridge DRC is kept in a state in which it is positioned relative to the main assembly 100A. That is, the cartridge DR is prevented from moving in the vertical direction by urging the lower surface portion 51 against the positioning portion 41 by the elastic force of the urging member 42. Further, the boss 502 is engaged in the groove 35*h*, so that the cartridge DR is prevented from rotating about the lower surface portion 51. Therefore, the cartridge DR is positioned (fixed) relative to the main assembly 100A. At this time, the eaves 56 are slightly separated from the frames 35*e* and 35*d* or lightly contact the frames 35*e* and 35*d*. Therefore, the eaves 56 do not interfere with the positioning of the cartridge DR relative to the main assembly 100A. Incidentally, the lower surface portion 51 of the shaft supporting portion 60 has a concentrically circular shape with respect to (coaxially with) the drum 1 and the coupling engaging portion (coupling gear) 53. For that reason, irrespective of positional accuracy of the groove 35*h*, the drum 1 and the coupling engaging portion 53 are positioned relative to the main assembly 100A with accuracy. With respect to other cartridges DRY, DRM and DRK, the same constitution is employed. The above-described urging member 42, the urging spring 43 and the positioning portion 41 constitute the positioning means for positioning the cartridge DR relative to the main assembly 100A when the tray 35 is located at the inside position X.

The cartridge DVC is provided with an inclined surface portion (second urging portion) 401*a* which is a part of an upper surface 401*b* of the frame 401 and is provided on an opposite side from the side where the cartridge DRC paired with the cartridge DVC is disposed (FIG. 11). The inclined surface portion 401*a* is inclined from the upper surface 401 toward a side surface 401*c* in a downward direction. Here, the side surface 401*c* is provided on one end side, with respect to the widthwise direction of the cartridge DVC, opposite from the side where the cartridge DRC paired with the cartridge DVC is disposed. That is, the inclined surface portion (developing cartridge-side portion to be urged) 401*a* is provided, along the longitudinal direction of the developing roller 4*a*, with respect to the widthwise direction perpendicular to the longitudinal direction and on one end side opposite from the side where the cartridge DR is supported. The inclined surface portion 401*a* is inclined from the upper surface of the B cartridge DV toward the one end side. Here, the inclined surface portion 401*a* receives the urging force from the urging member (developing cartridge-side urging member) 42 in the state in which the tray 35 is located at the inside position X. That is, the inclined surface portion 401*a* receives the urging force for urging the lower surface portions 51 against the positioning portions 41Y1, 41M1, 41C1 and 41K1 and for applying to the cartridge DV the rotation moment for permitting the rotation of the developing roller 4*a* in the direction in which the developing roller 4*a* urges the drum 1. The urging member (main assembly-side developing cartridge urging member) 410 contacts the inclined surface portion 401*a* to apply the urging force (elastic force, arrow of direction) to the cartridge DVC. The lower surface portions 404 of the driving-side and non-driving-side shaft supporting portions 61 are urged against the positioning portions 41C provided relative to the main assembly 100A by a vertical component of the urging force of the urging member 410, so that the cartridge DVC is engaged. Further, the cartridge DVC is rotated about an engaging portion toward the cartridge DRC side by a horizontal component of the urging force. The engaging portion is a portion at which the lower surface portion 404 is engaged in the positioning portion 41C. As a result, the developing roller 4*a* contacts the drum 1 over its longitudinal direction. In this embodiment, a so-called contact development is employed.

As described above, the urging member (main assembly-side developing cartridge urging member) 410 urges the positioning portion 41 in the state in which the tray 35 is located at the inside position X. That is, the lower surface portions (first developing cartridge-side portion to be positioned) 404 are urged against the positioning portions 41Y1, 41M1, 41C1 and 41K1 (the above-described vertical component). Further, the urging member 410 applies to the cartridge DV the rotation moment (the horizontal component) by the developing roller 4*a* urges the drum 1. As described above, When the supporting members 34L and 34R and the tray 35 are lowered obliquely rearward in interrelation with the closing operation of the door 31, the inclined surface portion 401*a* of the cartridge DV reaches a position in which it is to be urged by the urging member 410. Thus, the urging member 410 urges the inclined surface portion 401*a* of the cartridge DV. Incidentally, according to this embodiment, the urging member 410 is located at an urging position in which it always urges the inclined surface portion 401*a* of the cartridge DV. However, the position of the urging member 410 is not limited thereto. The urging member 410 may also be configured, similarly as in the case of the urging member 42, so as to be movable between the urging position and a retracted position. An example for this will be described in FIG. 2.

By optimizing the horizontal component of the urging force, the developing roller 4*a* is urged against the drum 1 with a proper urging force. Further, the lower surface portion of the shaft supporting portion 61 of the cartridge DVC has the concentrically circular shape with respect to the shaft supporting portion 61. That is, the lower surface portion 404 is coaxial with the shaft supporting portion 61 (the developing roller 4*a*). Therefore, the cartridge DVC is positioned about the developing roller 4*a* relative to the main assembly 100A. Further, irrespective of the magnitude of the horizontal component of the urging force, the coupling engaging portion 54 is positioned relative to the main assembly 100 with accuracy.

Next, the positioning of the cartridge DV relative to the main assembly 100A will be described. That is, the cartridge DV is urged at the lower surface portion 404 against the positioning portion 41 by the vertical component of the elastic force by which the urging member 410 urges the inclined surface portion 401*a*. Further, to the cartridge DV, by the horizontal component of the elastic force, the rotation moment is applied on the side toward the cartridge DR (in an arrow g direction in FIG. 17(*a*)) with the lower surface portion 404 as the center. Incidentally, the boss (second developing cartridge-side portion to be positioned) 412 is loosely engaged in a groove (first supporting member-side preventing portion) 35*i*. As a result, the cartridge DV is allowed to rotate about the lower surface portion 404. The boss (second developing cartridge-side portion to be positioned) 412 is provided below the eave 403 in a state in which the cartridge DV is supported by the tray 35. Further, the boss 412 is loosely engaged in the groove (first supporting member-side preventing portion) 35*i* provided with respect to the tray 35 and permits the rotation of the developing roller 4*a* in the direction in which the developing roller 4*a* urges the drum 1. As a result, the developing roller 4*a* urges the drum 1. In this state, the cartridge DV is positioned (fixed) relative to the main assembly 100A. At this time, the eaves 403 are slightly separated from the frames 35*e* and 35*d* or lightly contact the frames 35*e* and 35*d*. Therefore, the eaves 403 do not interfere with the positioning of the cartridge DV relative to the main assembly 100A.

Also in the case of the other cartridges DVY, DVM and DVK, the same constitution is employed. As described above, the urging member 410, the urging spring 411 and the positioning portion 41 constitute the positioning means for positioning the cartridge DV relative to the main assembly 100A.

Figure 12:
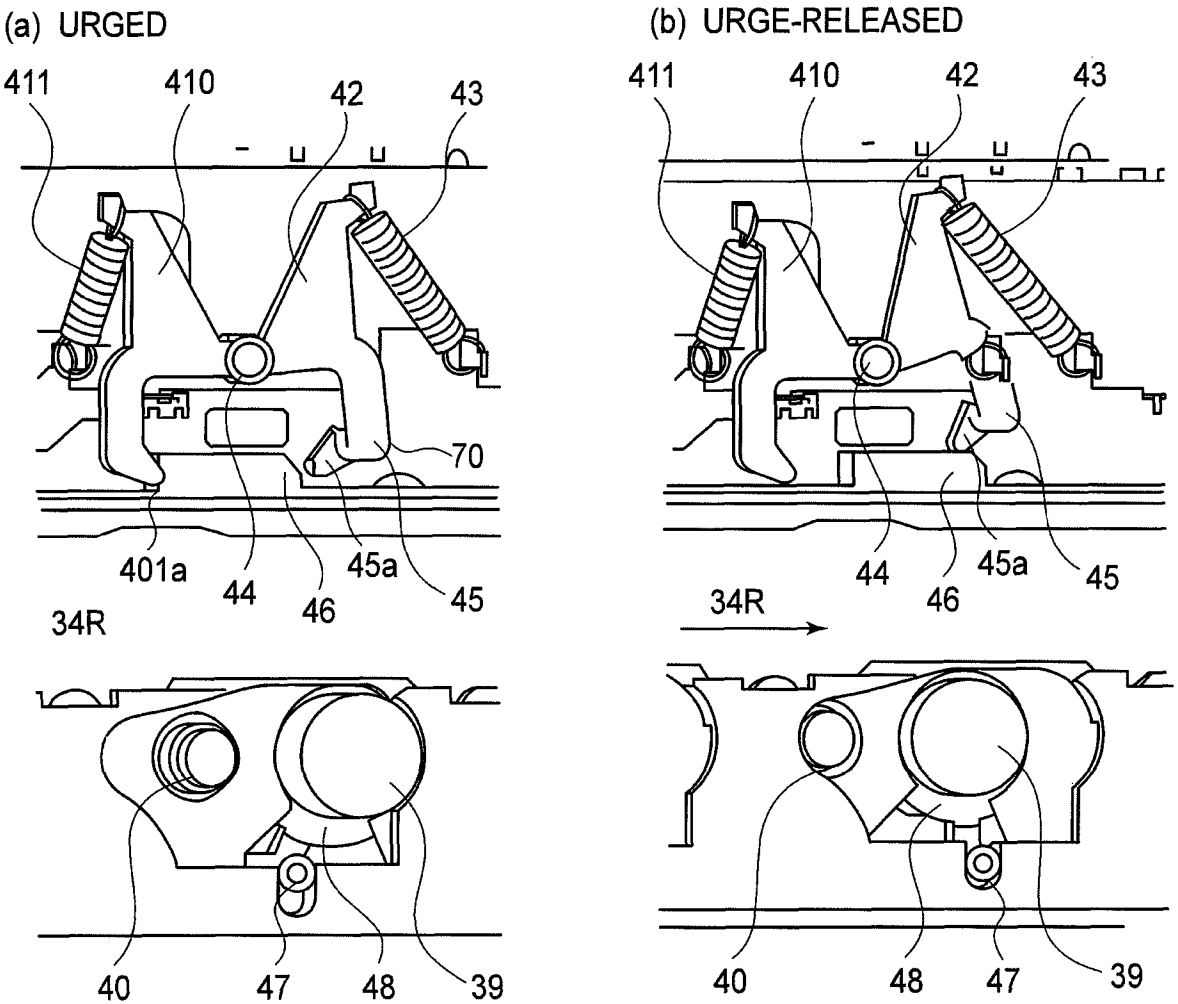
FIGS. 12(*a*) and 12(*b*) are perspective views for illustrating an interface portion, to be located in the neighborhood of the cartridges, to be released in interrelation with movement of the tray holding member.

FIGS. 12(*a*) and 12(*b*) are enlarged views of the drum driving coupling (drum drive output portion) 39 and the development driving coupling (development drive output portion) 40 which are provided on the main assembly 100A side. In order to simplify the figures, the cartridges DR and DV are not illustrated. The urging member 42 is provided on the main assembly 100A side so as to be rotatably about a supporting shaft 44. In an urged state (a closed state of the door 31) shown in FIG. 12(*a*), by a spring force (elastic force) of an urging spring (elastic member) 43, a driving side upper surface (portion to be urged) 70 of the cartridge DR is urged by a lower portion 45. In an urge-released state (an open state of the door 31) shown in FIG. 12(*b*), the lever portion 45 is pushed up by an urging member pushing-up portion 46 provided on the tray supporting member 34R. As a result, the urging against the cartridge DR is released in interrelation with the movement of the tray supporting member 34R. That is, in interrelation with the movement of the tray supporting member 34R, an end portion 45*a* of the lever portion 45 is pushed up by the pushing-up portion 46. As a result, the urging of the cartridge DR by the urging member 42 is released (FIGS. 12(*a*) and 12(*b*)).

Further, the coupling 39 is disengaged from the coupling engaging portion (drum drive input portion) 53, and the coupling 40 is disengaged from the coupling engaging portion (development drive input portion) 54. For this purpose, a releasing lever 48 (means for disconnecting the cartridge driving means) is provided rotatably relative to the coupling 39. Then, in interrelation with the movement of the supporting member 34R, a pin 47 provided on the lever 48 is moved from the position of FIG. 12(*a*) to the position of FIG. 12(*b*). By this operation of the lever 48, the couplings 39 and 40 are retracted to the position of FIG. 12(*b*). That is, the engagement of the couplings 39 and 40 in the coupling engaging portions 53 and 54 of the cartridges DR and DV is released.

As shown in FIG. 12(*b*), in a state in which the couplings 39 and 40 and the urging member 42 are released in interrelation with the movement of the supporting members 34L and 34R, the tray 35 is slidable along the supporting members 34L and 34R. Therefore, the tray 35 can be accommodated in and pulled out from the main assembly 100 while carrying the cartridges. As described above, in interrelation with the closing operation of the door 31 with respect to the urging member 42 and in the step in which the supporting members 34L and 34R and the tray 35 are lowered obliquely rearward, the pushing-up portion 46 is separated from the end portion 45*a* of the lever portion 45 (FIG. 12(*a*)). As a result, the urging member 42 is located at the urging position by the elastic force of the spring 43. As a result, the urging member 42 urges the upper portion 70 of the cartridge DR. Incidentally, in interrelation with the opening operation of the door 31 with respect to the urging member 42 and in the step in which the supporting members 34L and 34R and the tray 35 are raised obliquely frontward, the pushing-up portion 46 contacts the end portion 45*a* of the lever portion 45 (FIG. 12(*b*)). As a result, the urging member 42 is located at the retracted portion.

Incidentally, in this embodiment, when the tray 35 is located at the position X, a positioning releasing means for releasing a state in which each cartridge DV is positioned by the positioning means 410, 411 and 41 is not particularly provided. In this embodiment, when the tray 35 is pulled out, the urging member 410 for each cartridge DV is hit by the moving cartridge DV and is rotationally moved about the supporting shaft 44 in the same direction as the pulling-out direction (the arrow a direction) of the tray 35 while compressing the urging spring 411. As a result, each cartridge DV passes below the urging member 410. On the other hand, when the tray 35 is moved in an accommodating direction, the urging member 410 for each cartridge DV is hit by the moving cartridge DV and is rotationally moved about the supporting shaft 44 in the pushing-in movement direction (the arrow b direction) while expanding the urging spring 411. As a result, each cartridge DV passes below the urging member 410. Then, in a state in which the tray 35 is finally located at the inside position X, the urging member 410 is urged against the inclined surface portion 401*a* of the cartridge DV. As a result, each cartridge DV is kept in a state in which the cartridge DV is positioned relative to the main assembly 100A by the urging force (elastic force) of an associated urging member (elastic member) 410.

As described above, in the apparatus in this embodiment employing the pulling-out type constitution, the cartridges DR and DV can be separately exchanged even when either one of the cartridges is replaced first. In addition, the cartridge DR and DV can be exchanged without demounting screws or parts (positioning supporting member and knob). As a result, the user can simply replace only the cartridge, of the cartridges DR and DV, necessary to be exchanged.

Embodiment 2

In this embodiment, when the tray 35 is located at the position X in the apparatus 100 in Embodiment 1 described above, a positioning releasing means 500 for releasing a state in which each cartridge DV is positioned by the positioning means 410, 411 and 41 is provided. In this embodiment, the means for releasing the urging force to be applied to the cartridge DV by the urging member 410 is used. As a result, the urging force can be released in advance when the tray 35 is inserted into the main assembly 100A. Therefore, an operating force required for the user to insert the tray 35 into the main assembly 100A can be reduced, so that good usability can be obtained. Further, it is possible to prevent image defect due to creep deformation caused in the case where the developing roller 4*a* is urged against the drum 1 for a long time with the same phase.

Figure 13:
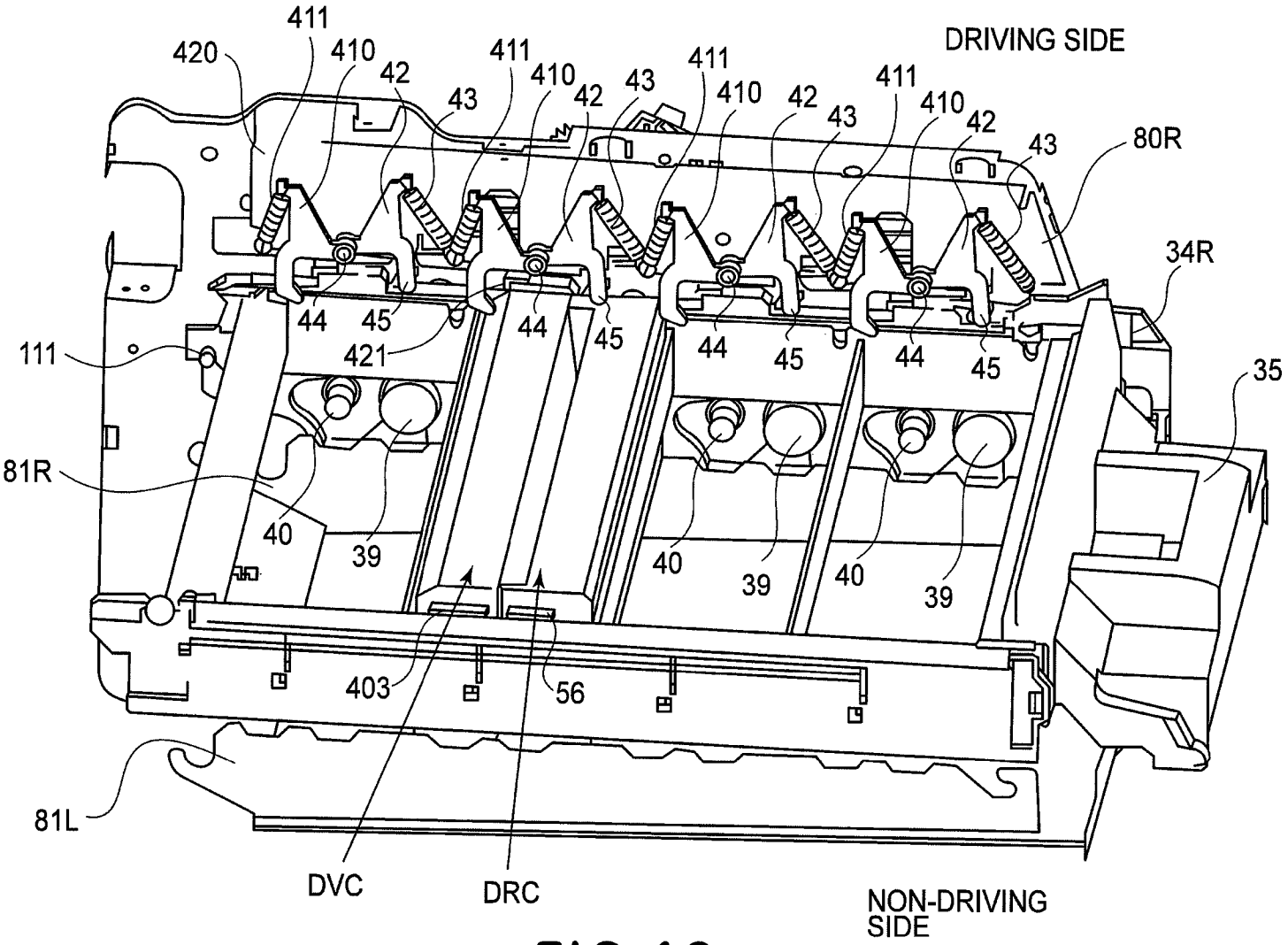
FIG. 13 is a perspective view showing a mechanism for releasing urging of the developing cartridges.
Figure 14:
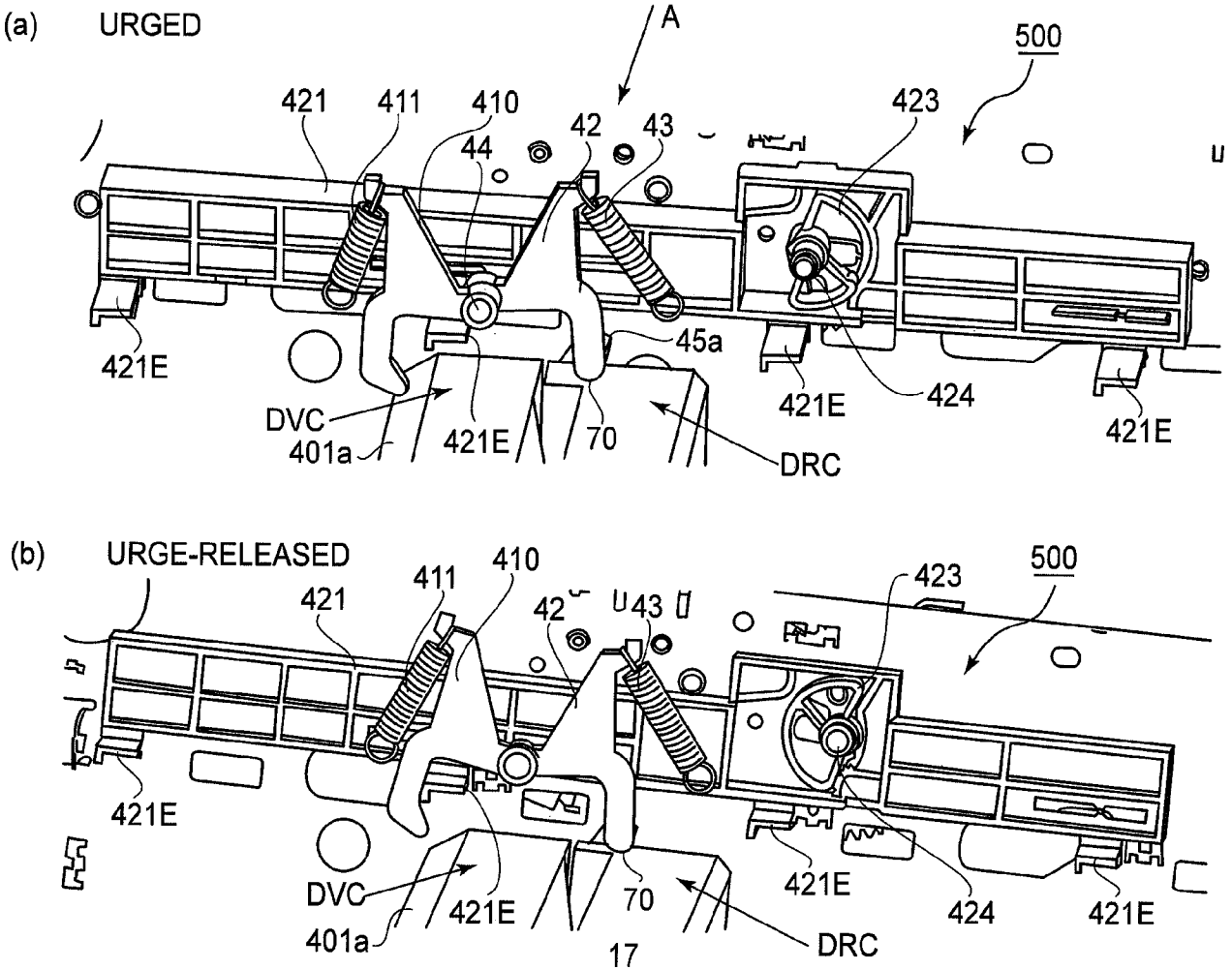
FIGS. 14(*a*) and 14(*b*) are perspective views specifically showing an urged state and an urge-released state of the developing cartridge, respectively.
Figure 15:
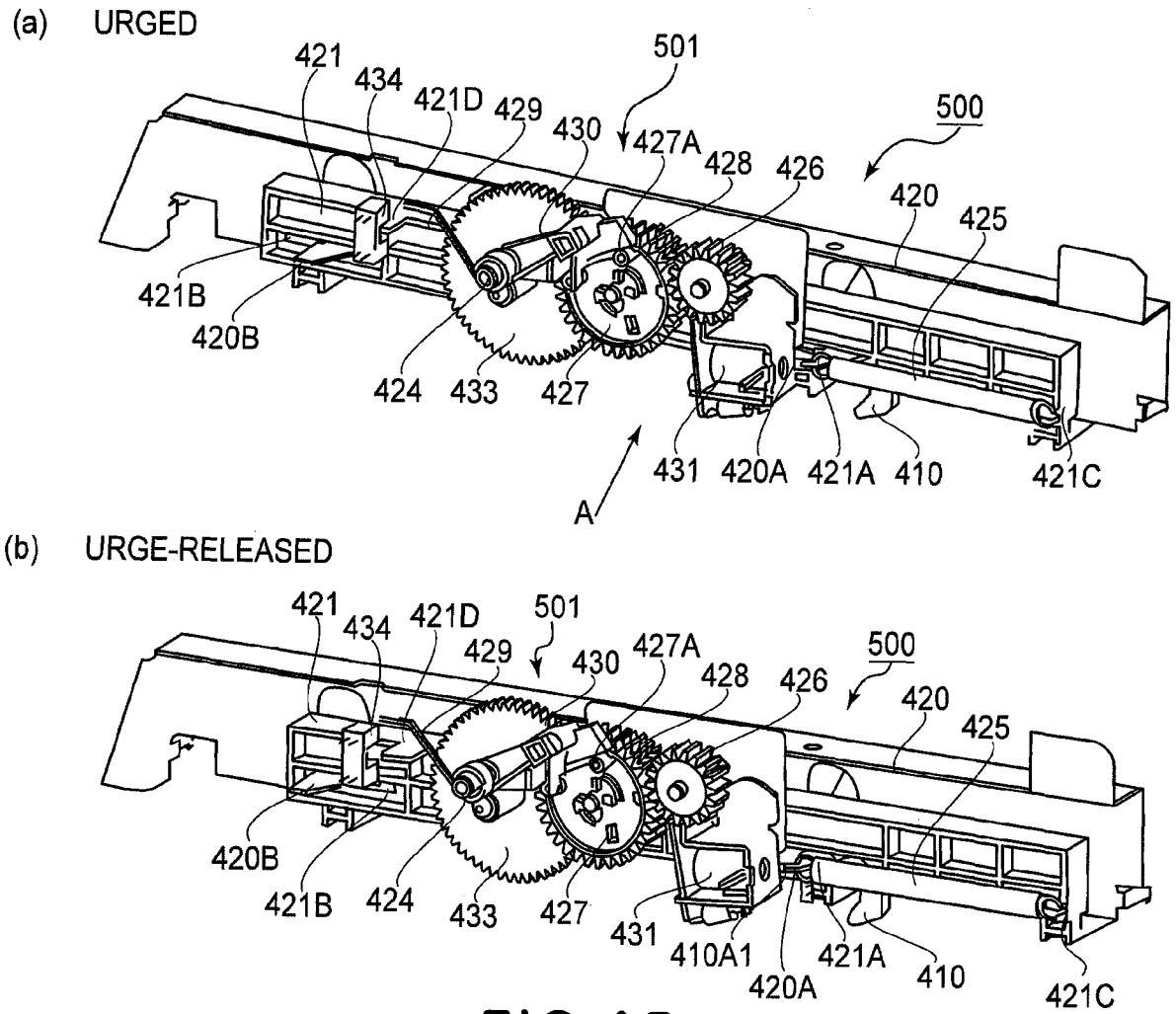
FIGS. 15(*a*) and 15(*b*) are side perspective views showing a driving mechanism for switching between the urged state and the urge-released state of the developing cartridge.
Figure 16:
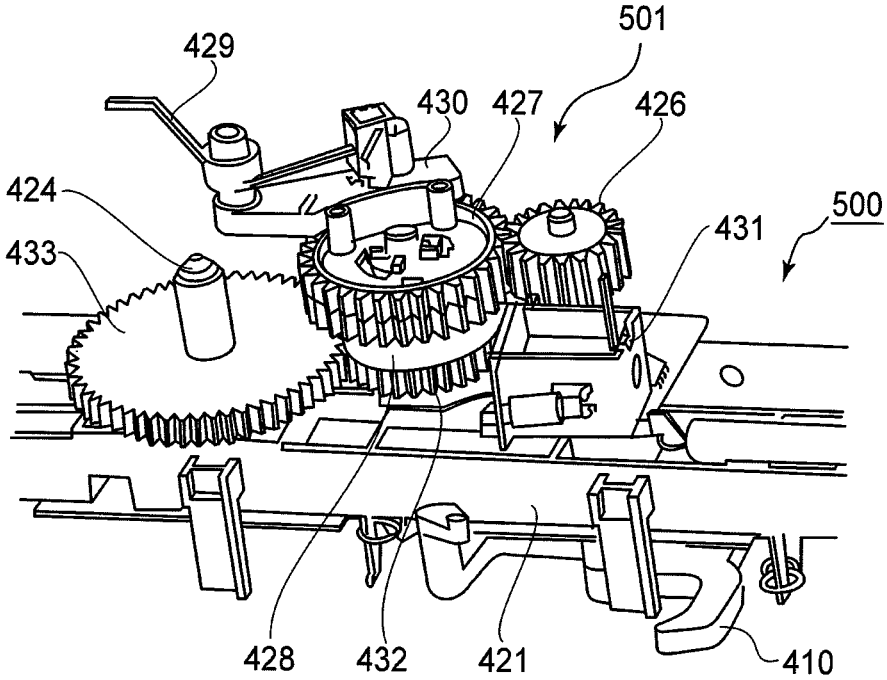
FIG. 16(*a*) is a bottom perspective view showing the driving mechanism for switching between the urged state and the urge-released state of the developing cartridge, and FIG. 16(*b*) is a perspective view of the developing cartridge provided with a mechanism for separating the developing roller from the drum in a state in which the urging of the developing cartridge is released.
Figure 16:
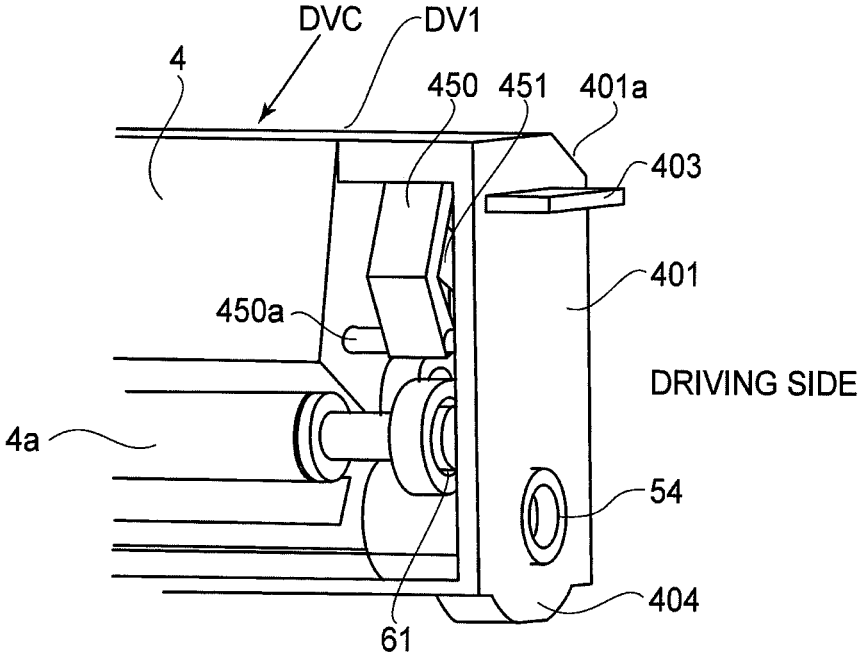

FIG. 13 shows a state in which the cartridges DRC and DVC are mounted in the tray 35 and accommodated in the main assembly 100A. The cartridge DRC is in the urged state by the urging member 42, and the cartridge DRV is in the urged state by the urging member 410. The difference of this embodiment from the embodiment shown in FIG. 11 is that a supporting metal plate 420 provided on the main assembly 100A side is provided with a releasing lever 421 (FIGS. 14(*a*) and 14(*b*)) horizontally supported slidably in the movement direction of the tray 35. FIGS. 14(*a*) and 14(*b*) show enlarged views in the neighborhood of the cartridges DRC and DVC. In order to simplify the figures, the tray 35, the supporting member 34R, the supporting metal plate 420, the stay members 81L and 81R, and the urging member 42 and the urging members 410 which are not associated with the cartridges DRC and DVC are not illustrated. FIG. 14(*a*) shows a state in which the cartridge DVC is urged by the urging member 410 similarly as in FIG. 13. The driving force from a driving source (not shown) is transmitted to a releasing cam 423 through a gear 426 (FIGS. 15(*a*) and 15(*b*)), so that the cam 423 is rotated 180 degrees. As a result, the lever 421 is horizontally moved (rearward) to the position shown by FIG. 14(*b*). As a result, a projection 421E provided on the lever 421 rotationally moves the urging lever 410 against the elastic force of the urging spring 411. As a result, the lever 410 is separated from the cartridge DVC (the inclined surface portion 401*a*), so that the urging force exerted on the cartridge DVC is released. Also in the cases of other cartridges DVY, DVM and DVK, the same constitution is employed. FIGS. 15(*a*) and 15(*b*) are schematic views as seen from a direction indicated by an arrow A in FIG. 14(*a*) and show a driving mechanism 501 for horizontally moving the lever 421 in the movement direction of the tray 35 by rotating the cam 423. FIG. 15(*a*) is a schematic view corresponding to FIG. 14(*a*) and shows a state in which the cartridge DVC is urged by the urging member 410. FIG. 15(*b*) is a schematic view corresponding to FIG. 14(*b*) and shows a state in which the urging force exerted on the cartridge DVC by the urging member 410 is released. FIG. 16(*a*) is an enlarged view of a major part of the driving mechanism 501 as seen from the direction indicated by the arrow A in FIG. 15(*a*).

Slit portions 421A and 421B of the lever 421 are engaged with cut and erected portions 420A and 420B of the supporting metal plate 420. As a result, the lever 421 is horizontally supported slidably in the front-rear direction. The cut and erected portion 420A is provided with a hook-shaped portion 420A1. Further, between the hook-shaped portion 420A1 and a hook portion 421C provided on the lever 421, a coil spring (elastic member) 425 is connected. Main constituent elements of the driving means (mechanism) 501 will be described. The driving means includes a driving gear 526 to which the driving force is to be transmitted from an unshown driving source and gears 427 and 428, having partly lacking tooth, to which the driving force is to be transmitted from the driving gear 426. The driving means 501 also includes an urging lever 430 for urging a cam portion 427A of the gear 427 tooth an elastic by a force applied from a twist coil spring (elastic member) 429 and an electromagnetic solenoid 431 for effecting one rotation control of the gear 427 by engagement of a claw portion provided on the gear 428. The driving means 501 further includes a driving gear 423 engaged so as to be integrally rotated with the gear 427 and includes a cam gear 433 to be driven by the driving gear 432 and to be integrally rotated with the releasing cam 423 (FIGS. 14(*a*) and 14(*b*)) through the shaft 424. The driving means 501 further includes a photo-interrupter 434 disposed at a position in which light is blocked or is not blocked by movement of a flag portion 421C of the lever 421. With reference to FIG. 16(*a*), an operation of one rotation control by the electromagnetic solenoid 431, the gear 427 and the gear 428 will be described.

When the power is turned on and a flapper of the solenoid is pulled, engagement of the flapper with a claw portion (not shown) of the gear 428 is released. Then, the gear 428 and the gear 426 are in mesh by the urging force of coil springs (not shown) provided inside the gears 427 and 428. When the gear 428 is driven and rotated by a predetermined angle, the gear 428 is engaged with a stopper portion (not shown). As a result, the gear 427 is rotated integrally with the driving gear 432, so that the cam gear 433 is driven and rotated. When the gear 428 is rotated one full turn, the flapper of the solenoid 431 to which the power input is turned off is engaged with the above-described claw portion (not shown) to stop the rotation. Further, by the lever 430, the rotation of the gear 428 is also stopped with the same rotational phase. The gears 427 and 428 have the same number of tooth and the number of tooth thereof is ½ of that of the cam gear 433. Therefore, the cam gear 433 is rotated 180 degrees depending on ON/OFF of the power input to the solenoid 431 to switch between the urged state and the urge-released state. As shown in FIGS. 15(*a*) and 15(*b*), with respect to the photo-interrupter 434, the light is blocked in the urged state and is not blocked in the urge-released state depending on the state of the flag portion 421C provided on the releasing lever 421. Therefore, the photointerruptor 434 can detect either one of the urged state and the urge-released state.

Control of the switching between the positioning state of the urging member 410 and the positioning-released state of the urging member 410 by the positioning releasing means 500 is automatically performed by the circuit portion 200 in accordance with a set program. The circuit portion 200 controls the positioning releasing means 500 so that the urging member 410 is kept in the positioning-released state during a normal operation (during non-image formation with a stopped printer) and controls the positioning releasing means 500 so that the urging member 400 is kept in the positioning state during the image formation (during printing with an operated printer). In this embodiment, the means for releasing the urging force to be applied to the cartridge DV by the urging member 410 is employed. As a result, the urging force can be released in advance when the tray 35 is inserted into the main assembly 100A. Therefore, an operating force required for the user to insert the tray 35 into the main assembly 100A can be reduced, so that good usability can be obtained. Further, it is possible to prevent creep deformation caused in the case where the developing roller 4*a* is urged by the drum 1 for a long time with the same phase. However, depending on the material of the developing roller 4*a*, even in the case where the developing roller 4*a* is urged by the drum 1 for the long time, the creep deformation does not occur in some instances. Therefore, the releasing means 500 is not necessarily required but the above-described effect can be achieved by providing the releasing means 500.

Embodiment 3

Figure 17:
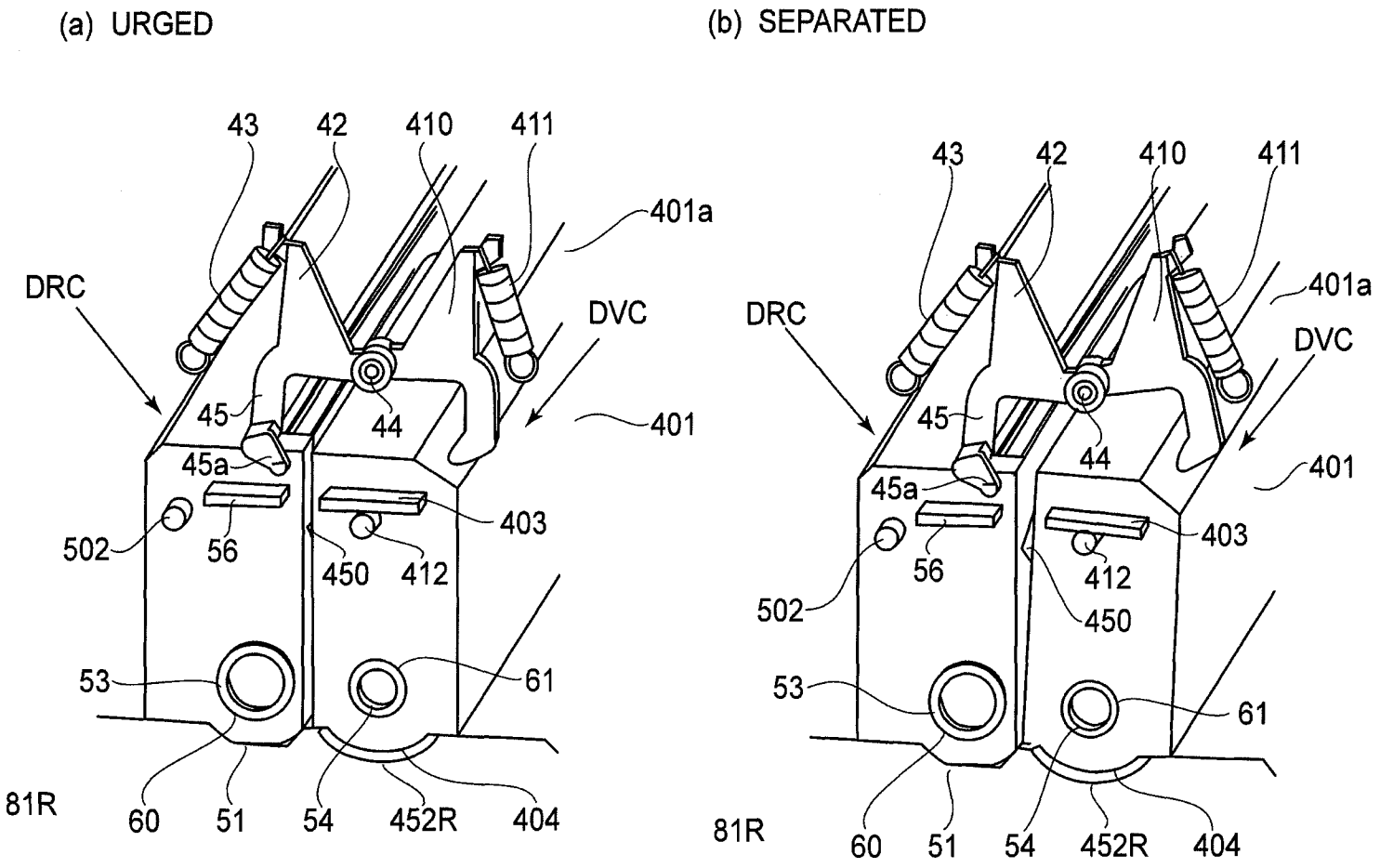
FIG. 17(*a*) is a perspective view showing the urged state of the developing cartridge, and FIG. 17(*b*) is a perspective view showing the urge-released state of the developing cartridge.
Figure 18:
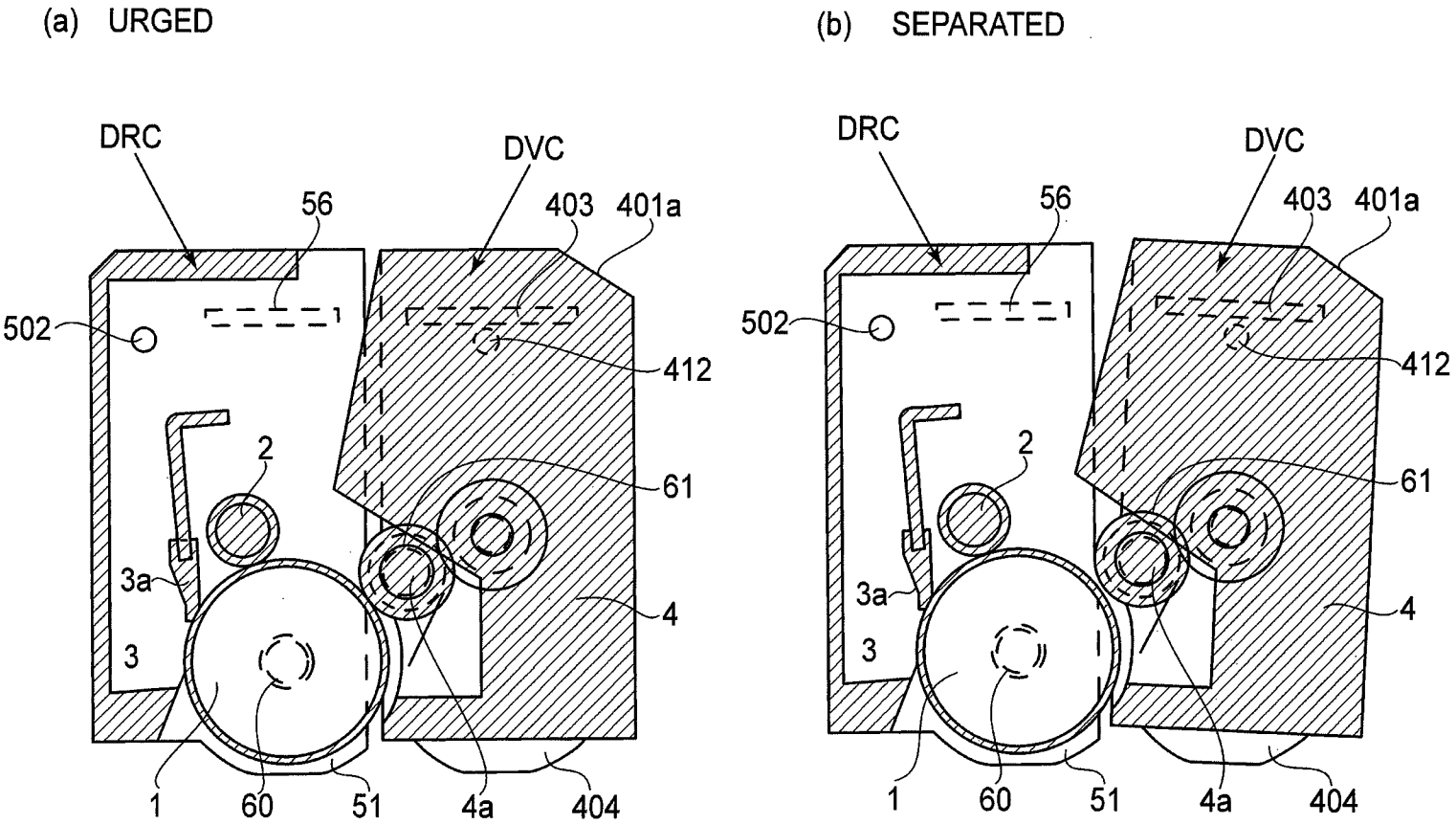
FIG. 18(*a*) is a sectional view showing a state in which the developing roller contacts the drum by urging the developing cartridge, and FIG. 18(*b*) is a sectional view showing a state in which the developing roller is separated from the drum by releasing the urging of the developing cartridge.

In this Embodiment 3, a means for separating the developing roller 4*a* and the drum 1 when the urging force applied to the cartridge DV by the urging member 410 is released by the positioning releasing means 500 described in Embodiment 2 is employed. That is, an elastic force imparting member for imparting an elastic force toward a direction in which the drum 1 of the cartridge DR and the developing roller 4*a* of the cartridge DV are separated from each other when the tray 35 is located at the position X will be described. According to this embodiment, only with developing timing (during image formation), the developing roller 4*a* can be caused to contact and urge the drum 1. That is, with timings other than the developing timing, the developing roller 4*a* can be separated from the drum 1. As a result, abrasion (wearing) between the developing roller 4*a* and the drum 1 can be suppressed to the minimum level. Incidentally, the developing roller 4*a* and the drum 1 may also lightly contact each other compared with those during the development (during the image formation) without being separated from each other. FIG. 16(*b*) is an enlarged view of the driving side of the cartridge DVC. A separating (spacing) lever 450 rotatably mounted to the frame 401 of the cartridge DVC and a coil spring (elastic member) 451 for imparting a force (elastic force) through the separating lever 450 toward a direction in which the cartridge DVC is separated from the cartridge DRC are provided. The lever 450 and the spring 451 constitute the elastic force imparting member. As shown in FIG. 16(*b*), the lever 450 is rotatably supported by a shaft 450*a*. The spring 451 urges the lever 450 toward the outside of the frame DV1. Further, in a state in which the cartridges DR and DV are supported by the tray 35, the lever 450 always urges the frame DV1 in a direction in which the developing roller 4*a* is separated from the drum 1. Thus, the drum 1 and the developing roller 4*a* are separated from each other. However, the cartridge DV is urged by the urging member 410 with a larger urging force during the image formation. Therefore, the developing roller 4*a* is urged against the drum 1. When the urging force by the urging member 410 is released, by the urging force of the lever 450, the developing roller 4*a* is separated from the drum 1 (FIGS. 17(*a*) and 17(*b*)). FIGS. 17(*a*) and 17(*b*) show a state in which the urging force is applied to the cartridge DVC by the urging member 410 and a state in which the urging force is removed (released), respectively. FIG. 18(*a*) is a sectional view showing a state in which the developing roller 4*a* contacts the drum 1 by the urging against the developing cartridge DV by the urging member 410 in the urged state of FIG. 17(*a*). FIG. 18(*b*) is a sectional view showing a state in which the developing roller 4*a* is separated from the drum 1 by the release of the urging against the developing cartridge DVC in the urge-released (separated) state shown in FIG. 17(*b*). In this embodiment, on the stay members 80L and 80R, shaft supporting members 452L and 452R are mounted (FIGS. 17(*a*) and 17(*b*)). In the case of this embodiment, the shape of the positioning portion 41 follows an outer shape of the shaft supporting members 452L and 452R. According to this embodiment, when the separating operation by which the developing roller 4*a* is separated from the drum 1 is performed, the lower surface portion 404 of the cartridge DVC slides on the positioning portion 41C provided relative to the main assembly 100A. As a result, it is possible to prevent an unstable operation by abrasion of the lower surface portion 404. Incidentally, also in the cases of the cartridges DVY, DVM and DVK, the same constitution is employed. However, it is not essential that the shaft supporting members 452L and 452R are provided. The materials for the lower surface portion 404 and the positioning portion 41 may be selected appropriately. By the above-described constitution, in a state in which the tray 35 to which the cartridges DR and DV are mounted is accommodated in the main assembly 100A, when the cartridge DV is not urged by the urging member 410, the developing roller 4*a* and the drum 1 are separated from each other. Further, in the urged state, the developing roller 4*a* is urged against the photosensitive drum 1 with a proper urging force. That is, the developing roller 4*a* can be caused to contact and can be urge against the drum 1 only with a developing timing, and with other timings, the developing roller 4*a* can be separated from the photosensitive drum 1. As a result, the abrasion between the developing roller 4*a* and the drum 1 can be minimized. Incidentally, the above-described elastic force imparting member is not necessarily required but is provided to achieve the above-described effects.

(Positioning of Cartridges DR and DV at Inside Position X)

As described above, the positioning of the cartridges DR and DV relative to the main assembly 100A is performed as follows.

Into the tray 35 located at the outside position Y, the user inserts the cartridges DR and DV from above (FIG. 4A). When the cartridge DR is inserted into the tray 35 from above, the insertion is made so that the boss 502 is engaged in the groove 35*h* and so that the eaves 56 are supported by the supporting members 34R and 34L. As a result, the cartridge DR is roughly supported by the tray 35 (FIGS. 7(*a*) and 9A). The boss 502 is provided at the driving side one end portion of the cartridge DR (FIGS. 8(*a*) and 11). As a result, when the cartridge DR receives the rotational force for rotating the drum 1, it is possible to efficiently prevent the cartridge DR from rotating. However, the boss 502 may also be provided at both ends of the cartridge DR with respect to the longitudinal direction of the cartridge DR (the longitudinal direction of the drum 1). Further, when the cartridge DV is inserted into the tray 35 from above, the insertion is made so that the boss 412 is engaged in the groove 35*i* and so that the eaves 403 are supported by the supporting members 34R and 34L. As a result, the cartridge DV is roughly supported by the tray 35 (FIGS. 7(*a*) and 9A). The boss 412 is provided at the driving side one end portion of the cartridge DR (FIGS. 8(*a*) and 11). As a result, when the cartridge DV receives the urging force by the urging member 410, the groove 35*i* is engaged with the boss 412 so as to permit the cartridge DV to rotate (FIGS. 12(*a*), 12(*b*), 14(*a*), 14(*b*), 17(*a*), 17(*b*), 18(*a*) and 18(*b*)). However, the boss 412 may also be provided at both ends of the cartridge DV with respect to the longitudinal direction of the cartridge DV (the longitudinal direction of the developing roller 4*a*). In these cases, according to this embodiment, even when either one of the cartridges DR and DV is mounted first, the cartridges DR and DV can be mounted in the tray 35. Further, even when either one of the cartridges DR and DV is demounted first, the cartridges DR and DV can also be demounted from the tray 35. In this regard, FIG. 19(*a*) illustrates the case where the cartridge DR is mounted first in the tray 35 and then the cartridge DV is mounted into the tray 35 or the case where the cartridge DV is demounted from the tray 35 in advance of the cartridge DR. FIG. 19(*b*) illustrates the case where the cartridge DV is mounted first in the tray 35 and then the cartridge DR is mounted into the tray 35 or the case where the cartridge DR is demounted from the tray 35 in advance of the cartridge DV. Incidentally, in order to mount the cartridges DR and DV at paper positions, marks of colors corresponding to yellow, magenta, cyan and black may also be put on the tray 35. This may only be required to mount the cartridges DR and DV at positions which are coincident with an associated color mark. Then, the user pushes the tray 35 into the main assembly 100A. Thereafter, the user closes the door 31. As described above, in interrelation with the closing operation of the door 31 with respect to the urging member 42 and in the step in which the supporting members 34L and 34R and the tray 35 are lowered obliquely rearward, the pushing-up portion 46 is separated from the end portion 45*a* of the lever portion 45. As a result, the urging member 42 is located at the urging position by the elastic force of the spring 43 (FIG. 12(*a*)). As a result, the urging member 42 urges the upper portion 70 of the cartridge DR. Incidentally, in interrelation with the opening operation of the door 31 with respect to the urging member 42 and in the step in which the supporting members 34L and 34R and the tray 35 are raised obliquely frontward, the pushing-up portion 46 contacts the end portion 45*a* of the lever portion 45. As a result, the urging member 42 is located at the retracted portion (FIG. 12(*b*)). Further, relative to the urging member 410, when the supporting members 34L and 34R and the tray 35 are lowered obliquely rearward in interrelation with the closing operation of the door 31, the inclined surface portion 401*a* of the cartridge DV reaches a position in which it is to be urged by the urging member 410. Thus, the urging member 410 urges the inclined surface portion 401*a* of the cartridge DV. Incidentally, according to Embodiment 1 described above, the urging member 410 is located at an urging position in which it always urges the inclined surface portion 401*a* of the cartridge DV. However, the position of the urging member 410 is not limited thereto. The urging member 410 may also be configured, similarly as in the case of the urging member 42, so as to be movable between the urging position and a retracted position. An example for this is described in the aforementioned FIG. 2.

Next, the positioning of the cartridge DR relative to the main assembly 100A will be described. With respect to the cartridges DR, when their upper surfaces 70 are urged by the urging members 42, their lower surface portions 51 are urged against the main assembly-side positioning portions 41Y2, 41M2, 41C2 and 41K2 (FIGS. 11, 12(*a*), 14(*a*) and 17(*a*)). That is, the respective cartridges DR are positioned (fixed) relative to the main assembly 100A in a state in which the bosses 502 are engaged in the grooves 35*h* and in a state in which the lower surface portions 51 are urged against the positioning portions 41Y2, 41M2, 41C2 and 41K2 (FIGS. 10B and 11). Each cartridge DR is in a state in which the boss 502 is tightly engaged in the groove 35*h* (but there is play). Thus, also when the cartridge DR receives the drum 1 rotational force from the main assembly 100A (when the image formation is effected), the cartridge DR is prevented from rotating about its lower surface portion 51. Therefore, the cartridge DR positioned relative to the main assembly 100A with accuracy during the image formation.

Next, the positioning of the cartridge DV relative to the main assembly 100A will be described. With respect to the cartridges DR, when their inclined surface portions 401*a* are urged by the urging members 410, their lower surface portions 404 are urged against the main assembly-side positioning portions 41Y1, 41M1, 41C1 and 41K1 (FIGS. 11, 12(*a*), 14(*a*) and 17(*a*)). That is, the respective cartridges DV are positioned relative to the main assembly 100A in the following state. Specifically, the respective cartridges DV are positioned relative to the main assembly 100A in a state in which the bosses 412 are loosely engaged in the grooves 35*i*, in a state in which the lower surface portions 404 are urged against the positioning portions 41Y1, 41M1, 41C1 and 41K1, and in a state in which the developing roller 4*a* urges the drum 1 (FIG. 18(*a*)). At this time, the cartridge DV is rotated about the lower surface portion 404 toward the cartridge DR side against the elastic force of the spring (elastic force imparting member) 451 by the urging of the urging member 410 against the inclined surface portion 401*a*. Then, the cartridge DV is positioned relative to the main assembly 100A in the state in which the developing roller 4*a* urges the drum 1 (FIGS. 10B and 11). This is because the boss 412 is loosely engaged in the groove 35*i* to permit the cartridge DV to rotate toward the cartridge DR side about the lower surface portion 404. Further, this is also because the urging member 410 urges the inclined surface portion 401*a* to cause the urging force including the vertical component and the horizontal component. With respect to the cartridge DV, the lower surface portion 404 is urged against the positioning portion 41Y1, 41M1, 41C1 or 41K1 by the vertical component of the urging force and the cartridge DV is rotated about the lower surface portion 404 toward the cartridge DR side by the horizontal component of the urging force. Therefore, the cartridge DV is positioned relative to the main assembly 100A with accuracy.

Incidentally, with respect to the first process cartridge-side portion to be positioned (the lower surface portion 51) and the first developing cartridge-side portion to be positioned (the lower surface portion 404), in this example they are provided at one end and the other end lower surfaces of the frames DR1 and DV1 with respect to the longitudinal direction of the cartridges DR and DV (FIGS. 7(*a*), 7(*b*), 8(*a*) and 8(*b*)). However, this embodiment is not limited thereto. For example, the portions to be positioned may also be not provided at the lower surfaces of the frame DR1 and DV1. However, by providing the portions to be positioned at the lower surfaces, it is possible to realize a compact structure of the cartridges DR and DV. Incidentally, the first process cartridge-side portion to be positioned may preferably be provided coaxially with the axial (shaft) line of the drum 1. As a result, the cartridge DR can be positioned relative to the main assembly 100A with the drum 1 as the center of the positioning. Further, the first developing cartridge-side portion to be positioned may preferably be provided coaxially with the axial line of the developing roller 4*a*. As a result, the cartridge DV can be positioned relative to the main assembly 100A with the developing roller 4*a* as the center of the positioning. Further, the process cartridge-side portion to be supported (eave 56) and the developing cartridge-side portion to be supported (eave 403) have the flat plate-like shape. However, this embodiment is not limited thereto. For example, a plurality of bosses may also be arranged. However, by forming the portions to be supported (eaves) in the flat plate-like shape, it is possible to stably support the cartridges DR and DV by the tray 35.

Further, after the tray 35 is pulled out to the outside position Y, the cartridges DR and DV can be demounted even when either one of the cartridges is demounted first. When the cartridge DR is demounted first, the cartridge DR is raised, so that the cartridge DV is rotated about the lower surface 404 in the direction in which the developing roller 4*a* is separated from the drum 1. Therefore, even when the drum 1 and the developing roller 4*a* have contacted each other, there is no damage on both of the drum 1 and the developing roller 4*a*. Further, when the cartridge DV is demounted first, the cartridge DV is raised, so that the developing roller 4*a* is separated from the drum 1. Therefore, there is no damage on both of the developing roller 4*a* and the drum 1. Also when the cartridges DR and DV are mounted, similar operations are performed and similar effects are obtained.

Other Embodiments (1) In the above-described embodiments, the tray 35 which is to be moved linearly in the horizontal direction with respect to the mounting surface F of the apparatus main assembly 100A is described. However, the tray (cartridge supporting member) 35 in the present invention is not limited thereto. For example, the tray 35 may also be movable linearly in a direction which intersects the longitudinal direction of the drum 1 and is the horizontal direction, the slanting upward direction or the slanting downward direction with respect to the mounting surface F of the main assembly 100A.

(2) The number of the sets (pairs) of the drum cartridges DR and the developing cartridges DV is not limited to four in the embodiments described above but may also be changed to two, three or five or more. Further, in the above-described embodiments, the color electrophotographic image forming apparatus including the plurality of pairs of the cartridges DR and the cartridges DV is described but the present invention is not limited thereto. The present invention is also applicable to a single color (monochromatic) electrophotographic image forming apparatus including a pair of the cartridge DR and the cartridge DV.

(3) The contact and separation between the drum 1 and the belt 13 may also be performed by a method in which the intermediary transfer belt unit 12 is moved relatively to the tray 35 supporting the cartridge DR and the cartridge DV or by a method in which both the belt unit 12 and the tray 35 are moved.

(4) In the above-described embodiments, the intermediary transfer belt unit 12 may also be a recording material (medium) covering transfer belt for holding and conveying the sheet recording material) P.

Further, in the above-described embodiments, the tray 35 supports the plurality of sets of the cartridges DR and DV side by side in the direction in which the longitudinal direction of the drum 1 of each cartridge DR and the longitudinal direction of the developing roller 4*a* of each cartridge DV are perpendicular to the pull-out direction a. However, the present invention is not limited thereto.

For example, in the above-described embodiments, the tray 35 supports the plurality of sets of the cartridges DR and DV side by side in the direction in which the longitudinal direction of the drum 1 of each cartridge DR and the longitudinal direction of the developing roller 4*a* of each cartridge DV are parallel to the pull-out direction a. However, the present invention is not limited thereto. That is, the present invention is applicable even in the case where each of the cartridges DR and DV is supported by the tray 35 with respect to the longitudinal direction of the cartridge extends along (is parallel to) the pull-out direction a of the tray 35.

Further, according to the above-described embodiments, when the cartridge pair of DVK and DRK located on the lowermost-stream side with respect to the pull-out direction a is mounted in and demounted from the tray 35, the entire tray 35 is not required to be located outside the apparatus main assembly 100A. Even in such a case, the tray 35 is pulled out toward the outside direction rather than the case where the cartridges DV and DR are located at the inside position X. Therefore, rather than the case where the cartridges DV and DR are located at the inside position X, the tray 35 is pulled out toward the front side of the apparatus main assembly 100A, so that the cartridges DV and DR are easy for the user to be exchanged.

Further, the present invention includes not only the case where the tray 35 is linearly moved but also the case where the tray 35 is rotationally moved. This is because the mounting and demounting operativity of the cartridge relative to the tray 35 is improved.

Further, in the above-described embodiments, the constitution in which the developing roller 4*a* and the drum 1 contact each other by the urging force of the urging member 410 is described but the present invention is not limited thereto. For example, the developing roller 4*a* may also be urged against the drum 1 through a spacer (not shown) provided at one end and the other end of the developing roller 4*a*. In this case, the developing roller 4*a* is urged toward the drum 1 in a state in which the developing roller 4*a* is spaced from the drum 1.

According the above-described embodiments, it was possible to improve demounting operativity for demounting the cartridges DV and DR from the tray 35. Further, when the cartridges DV and DR are demounted from the tray 35, the cartridges can be separately demounted from each other and the demounting order is not limited. Further, when the cartridges DV and DR are demounted from the tray 35, the cartridges can be separately demounted from each other and the cartridges can be demounted even when either one of the cartridges is demounted first. Further, the user himself (herself) of the apparatus 100 can demount the cartridges DV and DR separately from each other. Further, according to the above-described embodiments, similar effects can be achieved also when the cartridges DV and DR are mounted in the tray 35.

According to the above-described embodiments, it was possible to provide the image forming apparatus 100 which had achieved the above-described effects. Further, according to the above-described embodiments, it was possible to provide the cartridges DR and DV which had achieved the above-described effects.

INDUSTRIAL APPLICABILITY

According to the present invention, it is possible to improve demounting operativity for demounting the process cartridge and the developing cartridge from the cartridge supporting member.

According to the present invention, when the process cartridge and the developing cartridge are demounted from the cartridge supporting member, the cartridges can be separately demounted from each other and the demounting order is not limited.

According to the present invention, when the process cartridge and the developing cartridge are demounted from the cartridge supporting member, the cartridges can be separately demounted from each other and can also be demounted even when either one of the cartridges is demounted first.

According to the present invention, it is possible to demount the process cartridge and the developing cartridge separately from each other by the user himself (herself).

While the invention has been described with reference to the structures disclosed herein, it is not confined to the details set forth and this application is intended to cover such modifications or changes as may come within the purpose of the improvements or the scope of the following claims.

The invention claimed is:

1. An image forming apparatus comprising:

a main assembly;

a supporting member capable of supporting a plurality of developing rollers and a plurality of photosensitive drums, said supporting member being movable substantially linearly between an inside position which is inside said main assembly and an outside position which is outside said main assembly, in a direction substantially perpendicular to axes of said developing rollers while supporting said developing rollers and said photosensitive drums;

a plurality of developing cartridges each having the developing roller and a pair of side walls opposing each other in a longitudinal direction of said developing roller, said developing cartridges being mountable to and dismountable from said supporting member, wherein in a state that said supporting member supports the plurality of photosensitive drums in the outside position, said developing cartridges are mountable to and dismountable from said supporting member, without removing said photosensitive drums;

an urging member for urging said developing cartridge to urge said developing roller toward said photosensitive drum; and a spacing member for spacing said developing roller and said photosensitive drum from each other, wherein said developing cartridges each include an upper surface facing upward when mounted to said supporting member and a projection projecting upwardly from the upper surface and having a shape providing a space through a middle portion thereof, wherein with respect to the longitudinal direction of said developing roller, a width of said projection is narrower than a distance between said pair of side walls, wherein each said developing cartridge includes a cylindrical engaging portion extending in the longitudinal direction of said developing roller to engage with said supporting member, wherein said cylindrical engaging portion protrudes from one side wall of said pair of side walls, and wherein said engaging portion is movably engaged with said supporting member to permit said developing cartridge to be moved relative to said photosensitive drum by said spacing member and said urging member.

2. An apparatus according to claim 1, wherein said supporting member includes a grip portion to be gripped when said supporting member is moved between the inside position and the outside position, wherein the upper surface of said developing cartridge is above said grip portion.

3. An apparatus according to claim 1, wherein said spacing member is reciprocable relative to said main assembly.

4. An apparatus according to claim 1, wherein said urging member urges said developing cartridge at a position more outside than said projection with respect to the longitudinal direction of said developing roller.

5. An apparatus according to claim 1, wherein said projection is disposed in a central portion of said developing cartridge with respect to the longitudinal direction of said developing roller.

6. An apparatus according to claim 1, wherein said projection has a reverse U-shape.

* * * * *